US009388980B2

(12) United States Patent
Abughazaleh

(10) Patent No.: US 9,388,980 B2
(45) Date of Patent: Jul. 12, 2016

(54) SYSTEMS AND METHODS FOR GASIFYING A HYDROCARBON FEEDSTOCK

(75) Inventor: John Abughazaleh, Sugar Land, TX (US)

(73) Assignee: Kellogg Brown + Root LLC, Houston, TX (US)

( * ) Notice: Subject to any disclaimer, the term of this patent is extended or adjusted under 35 U.S.C. 154(b) by 516 days.

(21) Appl. No.: 13/326,427

(22) Filed: Dec. 15, 2011

(65) Prior Publication Data

US 2013/0154278 A1 Jun. 20, 2013

(51) Int. Cl.

| | |
|---|---|
| ***C01B 3/36*** | (2006.01) |
| ***F23C 99/00*** | (2006.01) |
| ***C10J 3/48*** | (2006.01) |
| ***C10J 3/56*** | (2006.01) |
| *C10J 3/72* | (2006.01) |
| *C10J 3/84* | (2006.01) |

(52) U.S. Cl.

CPC ..... *F23C 99/00* (2013.01); *C10J 3/482* (2013.01); *C10J 3/56* (2013.01); *C10J 3/723* (2013.01); *C10J 3/84* (2013.01); *C10J 2300/093* (2013.01); *C10J 2300/0943* (2013.01); *C10J 2300/1637* (2013.01); *C10J 2300/1807* (2013.01); *C10J 2300/1823* (2013.01); *C10J 2300/1884* (2013.01); *F23C 2900/9901* (2013.01)

(58) Field of Classification Search

CPC ..... C10J 2300/1637; C10J 2300/0936
See application file for complete search history.

(56) References Cited

U.S. PATENT DOCUMENTS

| | | | | |
|---|---|---|---|---|
| 3,920,417 | A | 11/1975 | Fernandes | |
| 3,993,583 | A | 11/1976 | Seglin | |
| 4,328,007 | A | 5/1982 | Rafael | |
| 4,355,586 | A | 10/1982 | Brown | |
| 4,378,974 | A | 4/1983 | Petit et al. | |
| 4,385,906 | A | 5/1983 | Estabrook | |
| 4,400,180 | A | 8/1983 | Marion et al. | |
| 4,696,678 | A | 9/1987 | Koyama et al. | |
| 4,809,624 | A | 3/1989 | Van Der Burgt | |
| 4,881,947 | A * | 11/1989 | Parker | C10B 1/10 202/118 |
| 4,881,949 | A | 11/1989 | Brungel et al. | |
| 5,087,271 | A | 2/1992 | Stellaccio et al. | |
| 5,145,491 | A | 9/1992 | Schmitt et al. | |
| 5,415,673 | A | 5/1995 | Hilton et al. | |
| 5,954,000 | A | 9/1999 | Panos | |
| 6,033,447 | A | 3/2000 | Moock et al. | |
| 6,086,722 | A | 7/2000 | Webster, Jr. et al. | |
| 6,174,161 | B1 | 1/2001 | Slavejkov et al. | |
| 6,637,206 | B2 | 10/2003 | Thiessen | |
| 6,960,234 | B2 | 11/2005 | Hassett | |
| 7,138,001 | B2 | 11/2006 | Knez et al. | |
| 7,604,400 | B2 | 10/2009 | Thompson et al. | |
| 7,722,690 | B2 | 5/2010 | Shires et al. | |
| 7,932,296 | B2 | 4/2011 | Malhotra et al. | |
| 2002/0095866 | A1 * | 7/2002 | Hassett | C01B 3/36 48/199 FM |
| 2004/0237404 | A1 * | 12/2004 | Andrus et al. | 48/101 |
| 2004/0244289 | A1 * | 12/2004 | Morozumi et al. | 48/77 |

(Continued)

*Primary Examiner* — Imran Akram
(74) *Attorney, Agent, or Firm* — Gary M. Machetta

(57) ABSTRACT

Systems and methods for gasifying a hydrocarbon feedstock are provided. The hydrocarbon feedstock can be gasified in the presence of one or more particulates to produce a syngas and one or more carbon-containing particulates. At least a portion of the carbon of the one or more carbon-containing particulates can be combusted in a combustion process external to the gasifying of the hydrocarbon feedstock to produce a combustion gas. The combustion gas can be utilized in one or more processes external to the gasifying of the hydrocarbon feedstock.

18 Claims, 2 Drawing Sheets

(56) References Cited

U.S. PATENT DOCUMENTS

| | | | |
|---|---|---|---|
| 2006/0101715 | A1 | 5/2006 | Vlok et al. |
| 2006/0150510 | A1 | 7/2006 | Hiltunen et al. |
| 2008/0056971 | A1 | 3/2008 | Hughes |
| 2008/0081844 | A1 | 4/2008 | Shires et al. |
| 2008/0155899 | A1 | 7/2008 | Ramamurthy |
| 2009/0019767 | A1 | 1/2009 | Abughazaleh |
| 2009/0064582 | A1 | 3/2009 | Malhotra et al. |
| 2009/0114352 | A1 | 5/2009 | Rossi |
| 2009/0151250 | A1 | 6/2009 | Agrawal |
| 2009/0178338 | A1 | 7/2009 | Leininger et al. |
| 2009/0188165 | A1 | 7/2009 | Ariyapadi et al. |
| 2009/0261017 | A1 | 10/2009 | Iqbal et al. |
| 2009/0294328 | A1 | 12/2009 | Iqbal |
| 2010/0011664 | A1 | 1/2010 | Ariyapadi et al. |
| 2010/0040527 | A1 | 2/2010 | Randhava et al. |
| 2010/0132257 | A1 | 6/2010 | Agrawal et al. |
| 2011/0062012 | A1 | 3/2011 | Robinson |
| 2011/0107946 | A1* | 5/2011 | Suda ..... 110/341 |
| 2011/0243803 | A1* | 10/2011 | Andrus, Jr. ..... C10B 3/105 422/187 |
| 2012/0267575 | A1 | 10/2012 | Abughazaleh |

* cited by examiner

SYSTEMS AND METHODS FOR GASIFYING A HYDROCARBON FEEDSTOCK

BACKGROUND

1. Field

Embodiments described generally relate to the gasification of a hydrocarbon feedstock.

2. Description of the Related Art

Gasification is a high-temperature process usually conducted at elevated pressure to convert carbon-containing materials into carbon monoxide and hydrogen gas. Since this gas is often used for the synthesis of chemicals or synthetic hydrocarbon fuels, the gas is often referred to as "synthesis gas" or "syngas." Typical feedstocks to gasification processes include petroleum-based materials that are neat or residues of processing materials, such as heavy crude oil, coals, bitumen recovered from tar sands, kerogen from oil shale, coke, and other high-sulfur and/or high metal-containing residues; gases; and various carbonaceous waste materials. The feedstock materials can be reacted, e.g., in a gasifier, in a reducing (oxygen-starved) atmosphere at high temperature and (usually) high pressure. The resulting syngas typically contains about 85 percent of the feedstock's carbon content as carbon monoxide, with the balance being a mixture of carbon dioxide and methane.

A general approach to gasifying a hydrocarbon feedstock is to select a gasifying temperature that can achieve a very high, e.g., about 96 wt % to about 99 wt %, conversion of the carbon content of the hydrocarbon feedstock. Such approach limits the gasification process to generally highly reactive hydrocarbon feedstocks, e.g., lignite coals. The high temperatures required can also increase the specific consumption of oxidant in the gasification process with the associated high specific consumption of hydrocarbon feedstock per unit of useful syngas (hydrogen and carbon monoxide) produced. Also, in some cases, a gasification temperature that is high enough to achieve a very high carbon content conversion, e.g., about 96 wt % to about 99 wt %, is not practical as such a high temperature can exceed the softening temperature of the particulates e.g., ash, circulating throughout the gasification process. Exceeding the softening temperature of the particulates can result in particulate agglomeration that can prevent the circulation of the particulates and can lead to a stoppage of the gasification process.

There is a need, therefore, for improved systems and methods for gasifying a hydrocarbon feedstock.

DETAILED DESCRIPTION

Figure 1:
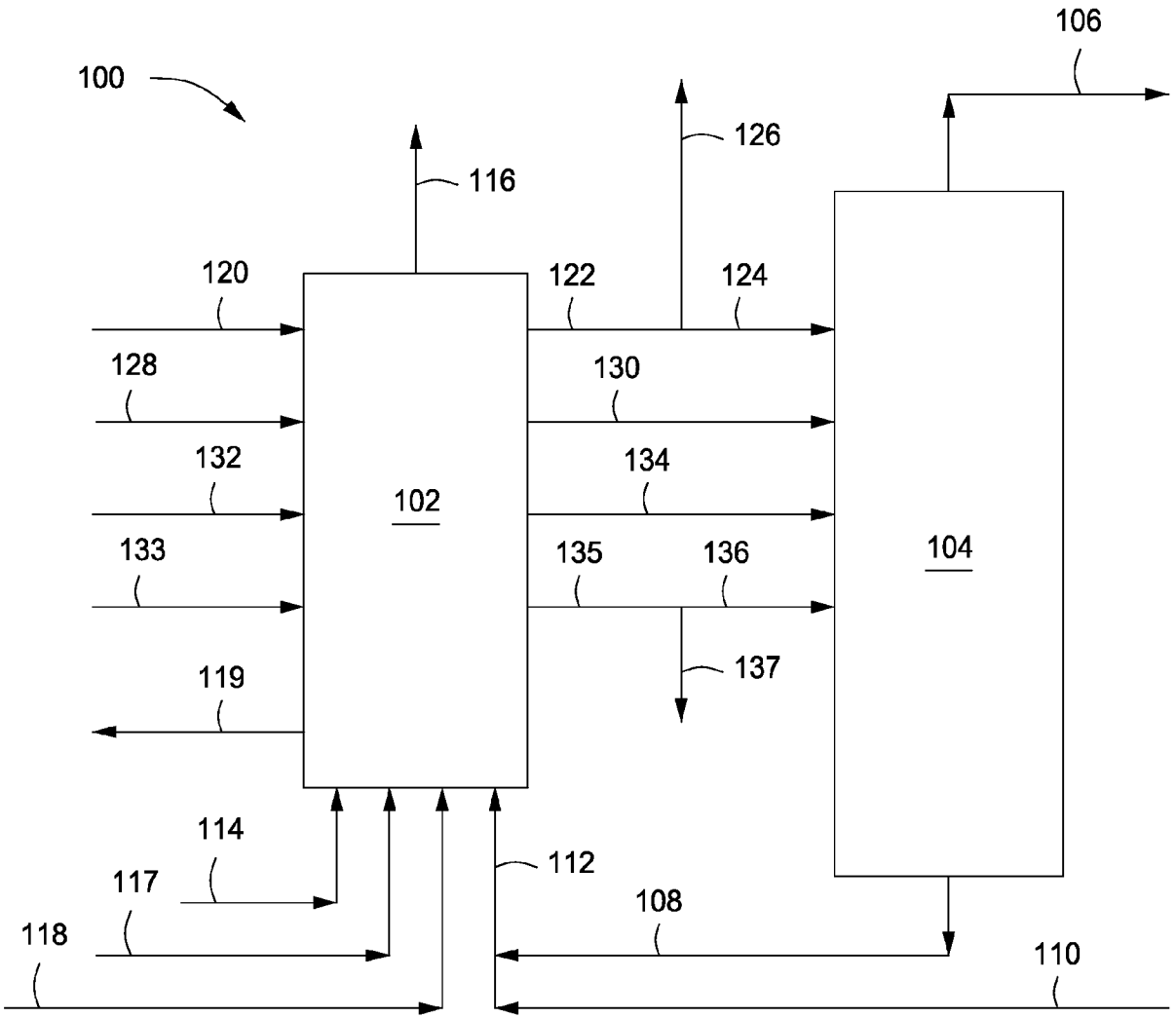
FIG. 1 depicts an illustrative gasification system for gasifying a hydrocarbon feedstock, according to one or more embodiments described.

Systems and methods for gasifying a hydrocarbon feedstock are provided. The hydrocarbon feedstock can be gasified in the presence of one or more particulates to produce a syngas and one or more carbon-containing particulates. At least a portion of the carbon of the one or more carbon-containing particulates can be combusted in a combustion process external to the gasifying of the hydrocarbon feedstock to produce a combustion gas. The combustion gas can be utilized in one or more processes external to the gasifying of the hydrocarbon feedstock.

The gasification system can include a combustion zone or two or more combustion zones arranged in series or parallel. The gasification system can also include a gasification zone or two or more gasification zones arranged in series or parallel. During the gasification of a hydrocarbon feedstock, a syngas and carbon-containing particulates, e.g., a carbon-containing coarse ash, can be recovered from the gasification zone. Carbon-containing particulates, e.g., a carbon-containing fine ash, can be recovered from the syngas in one or more processes for separating the carbon-containing fine ash from the syngas (e.g., a particulate control process) downstream of the gasification zone. At least a portion of the carbon-containing coarse ash, at least a portion of the carbon-containing fine ash, or a combination thereof can be introduced to one or more combustion zones. The combustion zone can be in fluid communication with the gasification zone. The combustion zone can be external relative to the gasification zone. The combustion zone can be external relative to the gasification zone such that the combustion zone and the gasification zone are not in fluid communication with one another. For example, a combustion gas produced within the combustion zone would not enter the gasification zone. In another example, the combustion gas produced within the combustion zone can be introduced or directed to another process external to the gasification zone and then the combustion gas can be introduced from the other process external to the gasification zone to the gasification zone or another process external to the gasification zone.

The carbon-containing coarse ash, the carbon-containing fine ash, or a combination thereof can be introduced to the combustion zone. The carbon-containing coarse ash and the carbon-containing fine ash can be introduced separately to the combustion zone. The carbon-containing coarse ash and the carbon-containing fine ash can be combined with one another and introduced to the combustion zone. At least a portion of the carbon of the carbon-containing coarse ash and/or at least a portion of the carbon of the carbon-containing fine ash can combust within the combustion zone in the presence of a combustion oxidant to produce the combustion gas. When additional combustion in the combustion zone is desired, a supplemental fuel can be introduced to the combustion zone. An atomizing stream, e.g., an atomizing steam, can be introduced to the combustion zone. Slagging can occur in the combustion zone. Optionally, at least a portion of the slag can be removed from the combustion zone. The combustion gas can be introduced to one or more processes external to the gasification zone, e.g., drying a moisture-containing hydrocarbon feedstock to produce a dried hydrocarbon feedstock prior to introducing the dried hydrocarbon feedstock to the gasification zone.

The combustion zone, the combustion gas, or a combination thereof can be utilized for and/or in one or more processes external to the gasification zone. For example, a boiler feed water can be in an indirect heat exchange relationship with the combustion zone and heat from the combustion gas can be transferred to the boiler feed water to produce a boiler feed water steam ("first steam"). The first steam can be introduced to the combustion zone, can be introduced to the gasification zone, can be exported to a process external to the gasification zone (e.g., supplying the first steam to a steam turbine to produce electrical power), or a combination thereof. The first steam can be supplied, directed, or otherwise introduced to a steam turbine to produce electrical power. For example, the first steam can be supplied, directed, or otherwise introduced to a steam turbine to produce mechanical shaft power to drive an electric generator to produce the electrical power.

A syngas, e.g., a syngas recycled from downstream of the gasification zone, can be in an indirect heat exchange relationship with the combustion zone and heat from the combustion gas can be transferred to the syngas to produce a heated syngas or heated recycled syngas that can be introduced to the gasification zone. A gasification oxidant ("first oxidant") can be in an indirect heat exchange relationship with the combustion zone and heat from the combustion gas can be transferred to the first oxidant to produce a heated first oxidant that can be introduced to the gasification zone.

Steam from the combustion zone, e.g., the first steam produced from the boiler feed water, and/or steam from a process within and/or downstream of the gasification zone, e.g., steam produced by heat recovery from one or more syngas heat exchangers, recycled syngas heat exchangers, coarse ash heat exchangers, fine ash heat exchangers, or a combination thereof, can be in an indirect heat exchange relationship with the combustion zone and heat from the combustion gas can be transferred to the steam to produce a second steam, e.g., a superheated steam. In general, the steam for producing the second steam as described herein can be from any source, e.g., from the combustion zone, from a process within and/or downstream of the gasification zone, from a source external to the combustion zone and/or the gasification zone, or a combination thereof. The second steam can be introduced to the gasification zone, can be exported to a process external to the gasification zone (e.g., supplying the second steam to a steam turbine to produce electrical power), or a combination thereof. The second steam can be supplied, directed, or otherwise introduced to a steam turbine to produce electrical power. For example, the second steam can be supplied, directed, or otherwise introduced to a steam turbine to produce mechanical shaft power to drive an electric generator to produce the electrical power.

Introducing steam, e.g., a first steam, a syngas heat exchanger steam, a recycled syngas heat exchanger steam, a coarse ash heat exchanger steam, a fine ash heat exchanger steam, or a combination thereof, to the combustion zone to produce the second steam can help increase overall process efficiency, can help reduce the capital cost of producing the second steam, e.g., can help reduce the capital cost of producing the second steam in the one or more syngas heat exchangers, recycled syngas heat exchangers, coarse ash heat exchangers, fine ash heat exchangers, or a combination thereof, can help provide for fine control of the second steam temperature by controlling the firing in the combustion zone, e.g., by optional supplementary firing in the combustion zone, or a combination thereof. For example, the one or more syngas heat exchangers, recycled syngas heat exchangers, coarse ash heat exchangers, fine ash heat exchangers, or a combination thereof can have a smaller number of coils utilized to produce the second steam, can have coils that are smaller in size, or a combination thereof.

Gasification of the hydrocarbon feedstock can be incomplete. In other words, gasification of the hydrocarbon feedstock can result in at least a portion of the hydrocarbon feedstock, e.g., carbon, that is not converted or gasified. The amount of the carbon in the hydrocarbon feedstock converted to carbon monoxide, carbon dioxide, methane, other carbon containing compounds, or any combination thereof during gasification of the hydrocarbon feedstock can be less than about 95 wt %, less than about 93 wt %, less than about 91 wt %, less than about 89 wt %, or less than about 87 wt %. For example, the carbon content conversion of the hydrocarbon feedstock can range from a low of about 80 wt %, about 85 wt %, about 87 wt %, or about 89 wt % to a high of about 90 wt %, about 94 wt %, about 96 wt %, or about 99 wt %. In another example, the carbon content conversion of the hydrocarbon feedstock can range from about 80 wt % to about 99 wt %, from about 80 wt % to about 95 wt %, from about 80 wt % to about 93 wt %, from about 85 wt % to about 96 wt %, or from about 87 wt % to about 94 wt %. The carbon content conversion refers to the amount of carbon in the hydrocarbon feedstock that is transformed into carbon monoxide, carbon dioxide, methane, other carbon containing compounds, or a combination thereof as the result of the gasification process that differ from the carbon or carbon containing compound(s) present in the hydrocarbon feedstock.

At least a portion of the carbon that is not converted or gasified can be deposited on one or more particulates present during the gasifying process to produce one or more carbon-containing particulates. At least a portion of the carbon that is not converted or gasified can be deposited on one or more carbon-containing particulates present during the gasifying process to produce one or more carbon-containing particulates that can contain the additional carbon from the depositing. At least a portion of the carbon that is not converted or gasified can be deposited on one or more particulates and/or carbon-containing particulates present during the gasifying process to produce one or more carbon-containing particulates and/or carbon-containing particulates that can contain the additional carbon from the depositing. It should be noted that depositing carbon on the particulates and/or carbon-containing particulates is a general phrase and should not be used to limit where the carbon is deposited with regard to the particulates and/or carbon-containing particulates. For example, the carbon can be deposited on an outer surface of the particulates and/or carbon-containing particulates, in the particulates and/or carbon-containing particulates, e.g., deposited within cavities and/or pores of the particulates and/or carbon-containing particulates, or a combination thereof.

As used herein, the term "particulates" refers to particulates that do not have carbon present on and/or in the particulates or have a reduced amount of carbon present on and/or in the particulates as compared to carbon-containing particulates. As used herein, the term "carbon-containing particulates" refers to particulates that contain carbon, e.g., carbon can be present on and/or in the particulates or have more carbon present on and/or in the particulates as compared to the particulates. The particulates and/or carbon-containing particulates can include, but are not limited to, sand, ash, ceramic, limestone, or any combination thereof. The limestone can be crushed, pulverized, ground, powdered, or otherwise reduced in particle size. The ash can include any type of ash or mixtures thereof. Illustrative ash can include, but is not limited to, fly ash, gasifier ash, coarse ash, fine ash, or any combination thereof. For example, a fly ash can be from one or more pulverized coal combustion boilers. Also for example, a gasifier ash can be from a gasifier. The composition of the ash, e.g., fly, gasifier, coarse, and/or fine ash, can be non-carbon compounds. For example, the composition of the ash can include, but is not limited to, silicon dioxide, calcium oxide, magnesium oxide, aluminum oxide, iron oxide, or a combination thereof. The ceramic can include any type of ceramic compound(s) or material(s). For example, ceramic materials can include, but are not limited to, silicon dioxide, calcium oxide, magnesium oxide, aluminum oxide, iron oxide, titanium, phosphates, or a combination thereof.

As used herein, the terms "coarse ash" and "coarse ash particulates" are used interchangeably and refer to particulates produced within the gasifying process and having an average particle size ranging from a low of about 35 μm, about 45 μm, about 50 μm, about 75 μm, or about 100 μm to a high of about 450 μm, about 500 μm, about 550 μm, about 600 μm, or about 640 μm. For example, coarse ash particulates can have an average particle size of from about 40 μm to about 350 μm, about 50 μm to about 250 μm, about 65 μm to about 200 μm, or about 85 μm to about 130 μm. As used herein, the terms "carbon-containing coarse ash" and "carbon-containing coarse ash particulates" are used interchangeably and refer to coarse ash and coarse ash particulates that contain carbon, e.g., carbon can be present on the coarse ash, in the coarse ash, or a combination thereof, that can be produced within the gasifying process and having an average particle size ranging from a low of about 35 μm, about 45 μm, about 50 μm, about 75 μm, or about 100 μm to a high of about 450 μm, about 500 μm, about 550 μm, about 600 μm, or about 640 μm. For example, carbon-containing coarse ash can have an average particle size of from about 40 μm to about 350 μm, about 50 μm to about 250 μm, about 65 μm to about 200 μm, or about 85 μm to about 130 μm.

As used herein, the terms "fine ash" and "fine ash particulates" are used interchangeably and refer to particulates produced within the gasifying process and having an average particle size ranging from a low of about 2 μm, about 5 μm, or about 10 μm to a high of about 75 μm, about 85 μm, or about 95 μm. For example, fine ash particulates can have an average particle size of from about 5 μm to about 30 μm, about 7 μm to about 25 μm, or about 10 μm to about 20 μm. As used herein, the terms "carbon-containing fine ash" and "carbon-containing fine ash particulates" are used interchangeably and refer to fine ash and fine ash particulates that contain carbon, e.g., carbon can be present on the fine ash, in the fine ash, e.g., as a pure carbonaceous particulate, or a combination thereof, that can be produced within the gasifying process and having an average particle size ranging from a low of about 2 μm, about 5 μm, or about 10 μm to a high of about 75 μm, about 85 μM, or about 95 μm. For example, carbon-containing fine ash can have an average particle size of from about 5 μm to about 30 μM, about 7 μm to about 25 μM, or about 10 μm to about 20 μm.

In the gasifying and combusting processes, particulates, carbon-containing particulates, or a combination thereof can be present. In the gasifying process, a weight ratio of the particulates to the carbon-containing particulates can be about 50:50, about 40:60, about 30:70, about 20:80, about 10:90, about 5:95, or about 1:99. In the combusting process, a weight ratio of particulates to carbon-containing particulates can be about 50:50, about 40:60, about 30:70, about 20:80, about 10:90, about 5:95, or about 1:99.

In the gasifying process, the carbon-containing coarse ash can include an amount of carbon ranging from a low of about 0.3 wt %, about 0.4 wt %, about 0.5 wt %, or about 0.6 wt % to a high of about 7 wt %, about 8 wt %, about 9 wt %, or about 10 wt %. In another example, in the gasifying process, the carbon-containing coarse ash can include an amount of carbon ranging from about 0.3 wt % to about 10 wt %, from about 0.4 wt % to about 9 wt %, or from about 0.5 wt % to about 8 wt %. In the gasifying process, the carbon-containing fine ash can include an amount of carbon ranging from a low of about 0.3 wt %, about 0.4 wt %, about 0.5 wt %, or about 0.6 wt % to a high of about 34 wt %, about 36 wt %, about 38 wt %, or about 40 wt %. In another example, in the gasifying process, the carbon-containing fine ash can include an amount of carbon ranging from about 0.3 wt % to about 40 wt %, from about 0.4 wt % to about 38 wt %, or from about 0.5 wt % to about 36 wt %. In the combusting process, the carbon-containing ash, e.g., carbon-containing coarse ash and/or carbon-containing fine ash, at the end of combustion, can include an amount of carbon ranging from a low of about 0.1 wt %, about 0.2 wt %, about 0.3 wt %, or about 0.4 wt % to a high of about 2 wt %, about 3 wt %, about 4 wt %, or about 5 wt %. In another example, in the combusting process, the carbon-containing ash, e.g., carbon-containing coarse ash and/or carbon-containing fine ash, at the end of combustion, can include an amount of carbon ranging from about 0.1 wt % to about 5 wt %, from about 0.2 wt % to about 4 wt %, or from about 0.3 wt % to about 3 wt %.

Reducing the proportion of the hydrocarbon feedstock converted to carbon monoxide, carbon dioxide, methane, or a combination thereof can provide for one or more advantages, e.g., an increase in the number or types of hydrocarbon feedstocks that can be gasified. For example, to obtain a high carbon content conversion, e.g., about 96 wt % to about 99 wt %, the hydrocarbon feedstock is generally highly reactive, e.g., a lignite coal. Reducing the amount of the hydrocarbon feedstock converted to carbon monoxide, carbon dioxide, methane, or a combination thereof can facilitate the gasification of a less reactive hydrocarbon feedstock, e.g., a bituminous coal, a sub-bituminous coal, an anthracite coal, and/or a petroleum coke. A generally less reactive hydrocarbon feedstock, e.g., a bituminous coal, can have a volatile matter content (ASTM D388-05) ranging from a low of about 14%, about 15%, or about 16% to a high of about 29%, about 30%, or about 31%. For example, a generally less reactive hydrocarbon feedstock, e.g., a bituminous coal, can have a volatile matter content of from about 14% to about 31%, about 15% to about 30%, about 16% to about 29%, or about 17% to about 28%. A second generally less reactive hydrocarbon feedstock, e.g., an anthracite coal, can have a volatile matter content (ASTM D388-05) ranging from a low of about 2%, about 3%, or about 4% to a high of about 12%, about 13%, or about 14%. For example, a second generally less reactive hydrocarbon feedstock, e.g., an anthracite coal, can have a volatile matter content of from about 2% to about 14%, about 3% to about 13%, about 4% to about 12%, or about 5% to about 11%.

The hydrocarbon feedstock can include any carbon-containing material or combination of carbon-containing materials, whether gas, liquid, solid, or any combination thereof. While the following examples of hydrocarbon feedstock that can be utilized include both highly reactive feedstocks and less reactive feedstocks, an advantage can be that less reactive feedstocks can be more efficiently gasified. For example, the hydrocarbon feedstock can include, but is not limited to, biomass (e.g., plant and/or animal matter and/or plant and/or animal derived matter); coal (e.g., high-sodium and low-sodium lignite, lignite, bituminous, sub-bituminous, and/or anthracite, for example); oil shale; coke; petroleum coke; tar; asphaltenes; low ash or no ash polymers; hydrocarbon-based polymeric materials; and/or by-products derived from manufacturing operations. The hydrocarbon-based polymeric materials can include, for example, thermoplastics, elastomers, rubbers, including polypropylenes, polyethylenes, polystyrenes, including other polyolefins, homo polymers, copolymers, terpolymers, block copolymers, and blends thereof; PET (polyethylene terephthalate), poly blends, polyhydrocarbons containing oxygen; heavy hydrocarbon sludge and bottoms products from petroleum refineries and petrochemical plants such as hydrocarbon waxes; blends thereof, derivatives thereof; and combinations thereof.

The hydrocarbon feedstock can include a mixture or combination of two or more carbonaceous materials. For example, the hydrocarbon feedstock can include a mixture or combination of two or more low ash or no ash polymers, biomass derived materials, or by-products derived from manufacturing operations. In another example, the hydrocarbon feedstock can include one or more carbonaceous materials combined with one or more discarded consumer products, such as carpet and/or plastic automotive parts/components including bumpers and dashboards. Such discarded consumer products are preferably suitably reduced in size to fit within a gasifier. In yet another example, the hydrocarbon feedstock can include one or more recycled plastics such as polypropylene, polyethylene, polystyrene, derivatives thereof, blends thereof, or any combination thereof. Accordingly, the process can be useful for accommodating mandates for proper disposal of previously manufactured materials.

The hydrocarbon feedstock, if solid, can have an average particle size ranging from a low of about 1 μm, about 10 μm, about 50 μm, about 100 μm, about 150 μm, or about 200 μm to a high of about 350 μm, about 400 μm, about 450 μm, or about 500 μm. For example, the average particle size of the hydrocarbon feedstock, if solid, can range from about 75 μm to about 475 μm, from about 125 μm to about 425 μm, or about 175 μm to about 375 μm. In another example, the hydrocarbon feedstock, if solid, can be ground to have an average particle size of about 300 μm or less. The hydrocarbon feedstock, if solid, can be introduced to the gasifying process as a dry feed or can be conveyed to the gasifying process as a slurry or suspension. Suitable fluids for forming a slurry or suspension can include, but are not limited to, carbon dioxide, steam, water, nitrogen, air, syngas, or a combination thereof.

The reduced carbon content conversion can also provide for an advantage of utilizing a gasifying process temperature for the gasification of less reactive hydrocarbon feedstocks that can be lower than typical gasifying process temperatures required for the gasification of more reactive hydrocarbon feedstocks. For example, the temperature of the gasifying process, e.g., the temperature within the second mixing zone and/or the gasification zone of a gasifier as described in more detail below, can range from a low of about 700° C., about 750° C., about 800° C., about 850° C., or about 900° C. to a high of about 1,000° C., about 1,100° C., about 1,200° C., about 1,300° C., or about 1,400° C. or more. For example, the temperature of the gasifying process, e.g., the temperature within the second mixing zone and/or the gasification zone of a gasifier as described in more detail below, can range from about 700° C. to about 1,400° C., about 700° C. to about 1,300° C., about 700° C. to about 1,200° C., about 700° C. to about 1,100° C., about 750° C. to about 1,100° C., about 800° C. to about 1,100° C., about 800° C. to about 1,050° C., or about 800° C. to about 1,000° C.

The thermodynamic efficiency of the gasifying process can be increased by maximizing the use of the volatile components of the hydrocarbon feedstock to produce hydrogen and carbon monoxide while utilizing the more refractory carbon-containing components to produce combustion gas and heat.

Another advantage of gasifying a hydrocarbon feedstock can be that the specific oxygen consumption can be reduced as more of the heat required for the gasifying can be produced by combusting at least a portion of the carbon of the carbon-containing particulates external to the gasifying. In addition, sulfur emissions from the combusting can be low as most of the sulfur contained in the hydrocarbon feedstock can be volatilized during gasifying. In the gasifying process, the hydrocarbon feedstock can have a concentration of sulfur and/or sulfur-containing compounds ranging from a low of about 0.1 wt %, about 0.2 wt %, about 0.3 wt %, or about 0.4 wt % to a high of about 2 wt %, about 3 wt %, about 4 wt %, or about 5 wt %. In another example, in the gasifying process, the hydrocarbon feedstock can have a concentration of sulfur and/or sulfur-containing compounds ranging from about 0.1 wt % to about 5 wt %, from about 0.2 wt % to about 4 wt %, or from about 0.3 wt % to about 3 wt %. In the gasifying process, the carbon-containing particulates, e.g., carbon-containing coarse ash and/or carbon-containing fine ash, can have a concentration of sulfur and/or sulfur-containing compounds of less than about 0.4 wt %, less than about 0.3 wt %, less than about 0.2 wt %, or less than about 0.1 wt %. In the combusting process, the carbon-containing particulates, e.g., carbon-containing coarse ash and/or carbon-containing fine ash, can have a concentration of sulfur and/or sulfur-containing compounds of less than about 0.4 wt %, less than about 0.3 wt %, less than about 0.2 wt %, or less than about 0.1 wt %.

Example processes external to the gasifying process that can utilize the combustion gas and/or heat produced from combusting at least a portion of the carbon of the one or more carbon-containing particulates can include, but are not limited to, heating a boiler feed water to produce a first steam, heating a syngas, e.g., a syngas recycled from downstream of the gasification zone, to produce a heated recycled syngas, heating a first oxidant to produce a heated first oxidant, heating a steam to produce a second steam, drying a moisture-containing hydrocarbon feedstock to produce a dried hydrocarbon feedstock, or a combination thereof.

The steam, e.g., first steam and/or steam produced by heat recovery from one or more syngas heat exchangers, recycled syngas heat exchangers, coarse ash heat exchangers, fine ash heat exchangers, or a combination thereof, can include low, medium, and/or high pressure steam. The second steam, e.g., superheated steam, can include low, medium, and/or high pressure superheated steam. The steam and/or second steam can have a temperature of about 150° C. or more, about 175° C. or more, about 200° C. or more, about 225° C. or more, about 250° C. or more, about 275° C. or more, about 300° C. or more, about 325° C. or more, about 350° C. or more, about 375° C. or more, about 400° C. or more, about 425° C. or more, about 450° C. or more, about 475° C. or more, about 500° C. or more, about 525° C. or more, or about 550° C. or more. The steam and/or second steam can have a temperature ranging from about 150° C. to about 550° C., about 175° C. to about 525° C., about 200° C. to about 500° C., about 225° C. to about 475° C., or about 250° C. to about 450° C. The steam and/or second steam can have a pressure of about 400 kPa or more, about 500 kPa or more, about 600 kPa or more, about 700 kPa or more, about 800 kPa or more, about 900 kPa or more, about 1,000 kPa or more, or about 1,100 kPa or more. The steam and/or second steam can have a pressure ranging from about 400 kPa to about 8,000 kPa, about 500 kPa to about 7,500 kPa, about 600 kPa to about 7,000 kPa, about 700 kPa to about 6,500 kPa, about 800 kPa to about 6,000 kPa, about 900 kPa to about 5,500 kPa, or about 1,000 kPa to about 5,000 kPa.

The first steam and/or second steam can be used for any number of applications. Illustrative uses for the first steam can include, but are not limited to, introducing the first steam to the combusting process, introducing the first steam to the gasifying of the hydrocarbon feedstock, exporting the first steam to a process external to the gasifying of the hydrocarbon feedstock, supplying the first steam to a steam turbine to produce electrical power, or a combination thereof. Illustrative uses for the second steam can include, but are not limited to, introducing the second steam to the gasifying of the hydrocarbon feedstock, exporting the second steam to a process external to the gasifying of the hydrocarbon feedstock, supplying the second steam to a steam turbine to produce electrical power, or a combination thereof. The first steam and/or the second steam can be supplied, directed, or otherwise introduced to a steam turbine to produce electrical power. For example, the first steam and/or the second steam can be supplied, directed, or otherwise introduced to a steam turbine to produce mechanical shaft power to drive an electric generator to produce the electrical power.

The amount of the first steam supplied to a steam turbine to produce electrical power compared to the total amount of the first steam produced can range from a low of about 30 wt %, about 35 wt %, about 40 wt %, or about 45 wt % to a high of about 65 wt %, about 70 wt %, about 75 wt %, or about 80 wt %. In another example, the amount of the first steam supplied to a steam turbine to produce electrical power compared to the total amount of the first steam produced can range from about 30 wt % to about 80 wt %, from about 30 wt % to about 75 wt %, or from about 30 wt % to about 70 wt %. The amount of the second steam supplied to a steam turbine to produce electrical power compared to the total amount of the second steam produced can range from a low of about 30 wt %, about 35 wt %, about 40 wt %, or about 45 wt % to a high of about 65 wt %, about 70 wt %, about 75 wt %, or about 80 wt %. In another example, the amount of the second steam supplied to a steam turbine to produce electrical power compared to the total amount of the second steam produced can range from about 30 wt % to about 80 wt %, from about 30 wt % to about 75 wt %, or from about 30 wt % to about 70 wt %.

The heated syngas, e.g., the heated recycled syngas, the heated first oxidant, the dried hydrocarbon feedstock, or a combination thereof can be utilized in any manner that utilizes heated syngas, heated first oxidant, dried hydrocarbon feedstock, or a combination thereof. For example, the heated syngas, the heated first oxidant, the dried hydrocarbon feedstock, or a combination thereof can be introduced to the gasifying of the hydrocarbon feedstock. The moisture concentration of the dried hydrocarbon feedstock can range from a low of about 12 wt %, about 13 wt %, about 14 wt %, or about 15 wt % to a high of about 19 wt %, about 20 wt %, about 21 wt %, or about 22 wt %. In another example, the moisture concentration of the dried hydrocarbon feedstock can range from about 12 wt % to about 22 wt %, from about 13 wt % to about 21 wt %, or from about 14 wt % to about 20 wt %.

Controlling the temperature of the circulating particulates and/or carbon-containing particulates can help moderate a temperature increase generally associated with combustion in the gasifying process and/or can help moderate a temperature decrease generally associated with vaporization, cracking, and/or gasification in the gasifying process. For example, considering the gasifying process, a hydrocarbon feedstock can be introduced to the gasifying process and at least partially gasified therein to produce gasified hydrocarbons (syngas). The gasified hydrocarbons (syngas) can include, but are not limited to, hydrogen, carbon monoxide, carbon dioxide, methane, nitrogen, steam, or a combination thereof. At least a portion of the carbon of the circulating particulates and/or carbon-containing particulates can be combusted within the gasifying process in the presence of the heated first oxidant and/or a gasification oxidant ("second oxidant") to produce at least a portion of a combustion gas ("first combustion gas"), circulating particulates and/or carbon-containing particulates, and heat. At least a portion of the hydrocarbon feedstock can also be combusted within the gasifying process in the presence of the first combustion gas, e.g., when introducing at least a portion of the hydrocarbon feedstock after introducing the heated first oxidant and/or second oxidant to the gasifying process and combusting at least a portion of the carbon of the circulating particulates and/or carbon-containing particulates. At least a portion of the hydrocarbon feedstock can also be vaporized in the presence of the first combustion gas to produce vaporized hydrocarbons. At least a portion of the hydrocarbon feedstock can also be cracked in the presence of the gasified hydrocarbons to produce cracked hydrocarbons. At least a portion of the hydrocarbon feedstock can deposit on and/or in the circulating particulates and/or carbon-containing particulates to produce carbon-containing particulates or "coked" particulates. As such, the hydrocarbon feedstock can be combusted, vaporized, cracked, gasified, and/or deposited on and/or in the particulates and/or carbon-containing particulates within the gasifying process.

At least a portion of the first combustion gas, vaporized hydrocarbons, cracked hydrocarbons, and/or gasified hydrocarbons can be selectively separated from the particulates and/or carbon-containing particulates. For example, at least a portion of the gasified hydrocarbons can be selectively separated from the particulates and/or carbon-containing particulates to provide a hot gas product or syngas. At least a portion of the carbon deposited on and/or in the circulating particulates and/or carbon-containing particulates can be as a result of incomplete gasification and/or combustion of the hydrocarbon feedstock. At least a portion of the carbon deposited on and/or in the circulating particulates and/or carbon-containing particulates can continue to slowly gasify, can combust with the heated first oxidant and/or the second oxidant to produce carbon monoxide, e.g., when the particulates and/or carbon-containing particulates are circulated through the gasifying process, and/or can leave the gasifying process, e.g., as one or more carbon-containing particulates, e.g., as one or more carbon-containing coarse ash and/or carbon-containing fine ash, to be introduced to the combusting process.

The molar ratio of the oxygen in the total gasification oxidant, e.g., heated first oxidant, second oxidant, or a combination thereof, to hydrocarbon feedstock within the gasifying process, e.g., within a gasifier, can be maintained at a sub-stoichiometric proportion to promote the formation of carbon monoxide over carbon dioxide within the gasifying process. The molar ratio of the oxygen in the total gasification oxidant introduced to the gasifying process e.g., to the gasifier, to the total amount of carbonaceous material introduced to the gasifying process, e.g., the total amount of carbonaceous material in the hydrocarbon feedstock, can be about 0.15:1, about 0.2:1, about 0.24:1, about 0.3:1, or about 0.35:1. The molar ratio of the oxygen in the total gasification oxidant introduced to the gasifying process, e.g., to the gasifier, to the total amount of carbonaceous material introduced to the gasifying process can range from about 0.1:1 to about 0.5:1, about 0.15:1 to about 0.45:1, about 0.2:1 to about 0.4:1, or about 0.24:1 to about 0.35:1.

In the combusting process, a slight stoichiometric excess of combustion oxidant ("third oxidant") can be introduced to promote the complete or nearly complete combustion of the carbon of the one or more carbon-containing particulates within the combusting process, e.g., within a combustor. For example, promoting the complete or nearly complete combustion of the carbon of the one or more carbon-containing particulates within the combusting process can help reduce, or even help eliminate, the presence of carbon monoxide in the combustion gas ("second combustion gas"), e.g., combustor exhaust gas. The amount of the total excess third oxidant introduced to the combusting process to the total amount of carbonaceous material introduced to the combusting process, e.g., the total amount of carbonaceous material of the one or more carbon-containing particulates, can range from a low of about 10 wt %, about 11 wt %, about 12 wt %, or about 13 wt % to a high of about 17 wt %, about 18 wt %, about 19 wt %, or about 20 wt %. In another example, the amount of the total excess third oxidant introduced to the combusting process to the total amount of carbonaceous material introduced to the combusting process, e.g., the total amount of carbonaceous material of the one or more carbon-containing particulates, can range from about 10 wt % to about 20 wt %, from about 11 wt % to about 19 wt %, or from about 12 wt % to about 18 wt %.

The one or more third oxidants can be introduced, with or in conjunction with a supplemental fuel for combusting, to the combusting process and at least a portion of the carbon of the one or more carbon-containing particulates and, when utilized, at least a portion of the supplemental fuel, can be combusted in the presence of the one or more third oxidants to produce the second combustion gas and heat. The amount of third oxidant present within the combusting process, e.g., within a combustor, for combusting at least a portion of the carbon of the one or more carbon-containing particulates and, when utilized, at least a portion of the supplemental fuel, can be controlled such that a third oxidant concentration within the second combustion gas, after combusting at least a portion of the carbon of the one or more carbon-containing particulates and, when utilized, at least a portion of the supplemental fuel, is less than about 3 mol %, less than about 2 mol %, less than about 1 mol %, less than about 0.5 mol %, less than about 0.3 mol %, less than about 0.1 mol %, less than about 0.05 mol %, or less than about 0.01 mol %.

The temperature of the combusting process, e.g., the temperature within the combusting zone and/or the mixing zone of a combustor as described in more detail below, can range from a low of about 400° C., about 450° C., about 500° C., about 550° C., or about 600° C. to a high of about 1,000° C., about 1,050° C., about 1,100° C., about 1,150° C., or about 1,200° C. or more. For example, the temperature of the combusting process, e.g., the temperature within the combusting zone and/or the mixing zone of a combustor as described in more detail below, can range from about 400° C. to about 1,200° C., about 450° C. to about 1,150° C., about 500° C. to about 1,100° C., about 550° C. to about 1,050° C., about 600° C. to about 1,000° C., about 650° C. to about 950° C., or about 700° C. to about 900° C.

As used herein, the term "oxidant" can include any oxygen containing compound capable of contributing to the gasification of at least a portion of the hydrocarbon feedstock within a gasifying process ("gasification oxidant", e.g., heated first oxidant and/or second oxidant) or capable of contributing to the combusting of at least a portion of the carbon of the one or more carbon-containing particulates in a combusting process ("combustion oxidant", e.g., third oxidant). Illustrative oxidants can include, but are not limited to, air, oxygen, essentially oxygen, oxygen-enriched air, mixtures of oxygen and air, mixtures of air and/or oxygen with steam, mixtures of oxygen and one or more inert gases, for example, nitrogen and/or argon, or any combination thereof. The oxidant, e.g., the gasification oxidant or the combustion oxidant, can contain about 20 vol % oxygen or more, about 30 vol % oxygen or more, about 40 vol % oxygen or more, about 50 vol % oxygen or more, about 60 vol % oxygen or more, about 65 vol % oxygen or more, about 70 vol % oxygen or more, about 75 vol % oxygen or more, about 80 vol % oxygen or more, about 85 vol % oxygen or more, about 90 vol % oxygen or more, about 95 vol % oxygen or more, or about 99 vol % oxygen or more. As used herein, the term "essentially oxygen" refers to an oxygen stream containing more than 50 vol % oxygen. As used herein, the term "oxygen-enriched air" refers to a gas mixture containing from about 21 vol % oxygen to about 50 vol % oxygen. Oxygen-enriched air and/or essentially oxygen can be obtained, for example, from cryogenic distillation of air, pressure swing adsorption, membrane separation, or a combination thereof. The oxidant can be nitrogen-free or essentially nitrogen-free. As used herein, the term "essentially nitrogen-free" refers to an oxidant that contains about 5 vol % nitrogen or less, about 4 vol % nitrogen or less, about 3 vol % nitrogen or less, about 2 vol % nitrogen or less, or about 1 vol % nitrogen or less.

The one or more supplemental fuels that can be used for combusting at least a portion of the carbon of the one or more carbon-containing particulates can be a gas, liquid, solid, or a combination thereof. For example, the supplemental fuel for combusting can include one or more gaseous hydrocarbons, liquid hydrocarbons, solid hydrocarbons, or a combination thereof. Preferably the supplemental fuel for combusting can include one or more hydrocarbons that are gaseous and/or liquid at room temperature and atmospheric pressure. Hydrocarbons suitable for use as the supplemental fuel for combusting can include, but are not limited to, any hydrocarbon or combination of hydrocarbons having from 1 to about 40 carbon atoms, from 1 to about 30 carbon atoms, or from 1 to about 20 carbon atoms. Suitable hydrocarbons for use as a supplemental fuel for combusting can include alkanes, cycloalkanes, alkenes, cycloalkenes, alkynes, alkadienes, aromatics, alcohols, or a combination thereof. Suitable mixtures of hydrocarbons that can be used as the supplemental fuel for combusting can include, but are not limited to, natural gas, naphtha, gas oil, fuel oil, diesel, gasoline, kerosene, or a combination thereof. Other suitable materials for use as the supplemental fuel for combusting can include, but are not limited to, tars, asphaltenes, coal, hydrogen, biomass, or a combination thereof. In at least one example, the supplemental fuel for combusting can include, but is not limited to, coal, wood, asphaltenes, or a combination thereof. In at least one other example, the supplemental fuel for combusting can include, but is not limited to, diesel, gasoline, kerosene, naphtha, or a combination thereof.

The supplemental fuel for combusting can have a low sulfur content which can reduce or minimize sulfur emissions during combusting. For example, the supplemental fuel for combusting can contain less than about 200 ppm, less than about 150 ppm, less than about 100 ppm, less than about 75 ppm, less than about 50 ppm, or less than about 30 ppm sulfur and/or sulfur-containing compounds. In another example, the supplemental fuel for combusting can contain less than about 40 ppm, less than about 25 ppm, less than about 20 ppm, less than about 15 ppm, less than about 10 ppm, less than about 5 ppm, or less than about 1 ppm sulfur and/or sulfur-containing compounds.

Systems and methods for gasifying a hydrocarbon feedstock can include a single combustor or two or more combustors arranged in series or parallel. Systems and methods for gasifying a hydrocarbon feedstock can also include a single gasifier or two or more gasifiers arranged in series or parallel. Systems and methods for gasifying a hydrocarbon feedstock can also include one or more heat exchanger "coolers" and/or "heaters," one or more particulate control devices (PCDs), one or more separators, and one or more compressors or "recycle compressors."

The combustor can include any combustion device, system, or combination of devices and/or systems capable of at least partially combusting at least a portion of the carbon of the one or more carbon-containing particulates. The combustor can include a refractory lined chamber that includes one or more burner nozzles where a mixture of the one or more carbon-containing particulates introduced to the combustor together with the third oxidant, and optionally, the atomizing stream, e.g., atomizing steam, and optionally, when additional combustion is desired, the supplemental fuel, can be injected into a combustion zone of the combustor and combusted to produce a flow of the second combustion gas. For example, the combustor can include one or more combustion zones, with or without a refractory lining, one or more exhaust ducts or channels, and one or more heat exchangers. The combustor can at least partially combust at least a portion of the carbon of the one or more carbon-containing particulates in the presence of the third oxidant within the combustion zone to produce the second combustion gas or exhaust gas.

In another example, the combustor can include a mixing zone, for mixing the one or more carbon-containing particulates, third oxidant, and optionally atomizing stream, e.g., atomizing steam, and supplemental fuel, and a combustion zone for at least partially combusting the mixture of the one or more carbon-containing particulates, third oxidant, and optionally atomizing stream, e.g., atomizing steam, and supplemental fuel.

The process of combusting at least a portion of the carbon of the one or more carbon-containing particulates can be conducted utilizing various types of combustors. Examples of suitable combustors can include, but are not limited to, slagging combustors, ash furnaces, pulverized-coal furnaces, or a combination thereof. For example, a combustor suitable for use according to one or more embodiments discussed and described herein can be an ash furnace. The one or more combustors can include one or more heat exchangers for exchanging heat from the second combustion gas with one or more various fluids. The one or more heat exchangers can include, but are not limited to, single or multiple pass heat exchange devices such as shell and tube heat exchangers, plate and frame heat exchangers, spiral heat exchangers, bayonet type heat exchangers, α-tube heat exchangers, bare tube coil heat exchangers, extended-surface tube coil heat exchangers, and/or any similar systems and/or devices. For example, an exhaust duct of a combustor can contain one or more tubes where the exhaust duct serves as the shell to provide a shell and tube heat exchanger where the heat of the combustion can be indirectly exchanged with the various fluids flowing through the one or more tubes in the exhaust duct of the combustor.

Each gasifier can include one or more mixing or introduction zones, one or more gasification zones or risers, one or more disengagers or separators, one or more standpipes, and one or more transfer lines. If two or more gasifiers are included, each gasifier can be configured independent from the others or configured where any of the one or more mixing zones; gasification zones; separators; and standpipes can be shared.

The systems and methods of gasifying a hydrocarbon feedstock can be conducted utilizing various types of gasifiers. For example, the gasifier can include one or more circulating solids or transport gasifiers, one or more fixed bed gasifiers, one or more fluidized bed gasifiers, one or more entrained flow gasifiers, or a combination thereof. An example gasifier suitable for use as described herein can be a TRIG™ gasifier. The particulates and/or carbon-containing particulates within the gasifier, in addition to or in lieu of serving one or more other purposes, e.g., as a deposition surface for a portion of the hydrocarbon feedstock, the presence of the particulates and/or carbon-containing particulates within the gasifier can help to improve heat retention within the gasifier and/or can help to improve heat distribution throughout the gasifier. Any suitable type of circulating solids gasifier can be utilized. Suitable circulating solids or transport gasifiers can be as discussed and described in U.S. Pat. No. 7,722,690 and U.S. Patent Application Nos. 2008/0081844, 2008/0155899, 2009/0188165, 2010/0011664, and 2010/0132257.

The gasification zone of the gasifier can have a smaller cross-sectional area, e.g., diameter, than the first mixing zone and/or the second mixing zone. The residence time within the gasification zone can provide for char gasification, methane/steam reforming, tar cracking, water-gas shift reactions, and/or sulfur capture reactions. Generally, the residence time and high temperature conditions within the gasification zone can provide for a gasification reaction to reach equilibrium. The residence time of the hydrocarbon feedstock within the second mixing zone can be about 0.5 seconds, about 1 second, about 2 seconds, about 5 seconds, about 10 seconds, or more. The gas velocity through the gasification zone can range from about 3 meters per second (m/s) to about 28 m/s, from about 6 m/s to about 25 m/s, from about 9 m/s to about 22 m/s, from about 10 m/s to about 20 m/s, or from about 9 m/s to about 15 m/s. The gasification zone can operate at a higher temperature than the second mixing zone. The gasifier can be operated at a pressure ranging from about 50 kPa to about 5,000 kPa, about 101 kPa to about 4,480 kPa, about 350 kPa to about 4,130 kPa, or about 690 kPa to about 3,790 kPa.

The gasifier can also include one or more start-up heaters. The start-up heater can at least partially combust one or more start-up fuels to provide a start-up combustion gas that can assist in the start-up and/or the heat-up of the gasifier. It should be noted that the start-up combustion gas can be introduced to one or more locations within the gasifier. Alternatively, a start-up heater can indirectly transfer heat to a start-up medium that can then be introduced to the gasifier. Illustrative start-up mediums can include, but are not limited to, nitrogen, carbon dioxide, combustion gas products, e.g., a combustion gas product from the gasifier and/or the combustor, or a combination thereof. Also for example, the combustor can be used in addition to, or in lieu of, the start-up heater to assist in the start-up and/or heat-up of the gasifier.

For a fixed particulate bed gasifier, the particulates and/or carbon-containing particulates can be disposed within the gasifier prior to starting the gasifier. For a circulating solids or transport gasifier, the particulates and/or carbon-containing particulates can be introduced at any desired time, for example, before and/or during starting of the gasifier. For example, the particulates and/or carbon-containing particulates can be introduced or loaded into the gasifier prior to introducing the heated first oxidant, the second oxidant, a start-up combustion gas and/or a start-up medium from a start-up heater, when utilized, and/or the hydrocarbon feedstock. In another example, at least a portion of the particulates and/or carbon-containing particulates can be introduced to the gasifier prior to introducing the heated first oxidant, the second oxidant, and/or the start-up combustion gas and/or the start-up medium from the start-up heater, when utilized. In another example, additional particulates and/or carbon-containing particulates can be introduced to the gasifier while introducing the heated first oxidant, the second oxidant, and/or the start-up combustion gas and/or the start-up medium from the start-up heater, when utilized.

In another example, additional particulates and/or carbon-containing particulates can be introduced after the heated first oxidant, second oxidant, and/or the start-up combustion gas and/or start-up medium, when utilized, is introduced to the gasifier but before introduction of the hydrocarbon feedstock to the gasifier.

One or more circulation or fluidizing fluids can be introduced to the gasifier, e.g., to one or more transfer lines, the standpipe, a recycle line, or a combination thereof in order to provide a motive fluid and/or an aeration fluid within the gasifier for circulating the particulates and/or carbon-containing particulates within the gasifier. Illustrative circulation or fluidizing fluids can include, but are not limited to, inert gases such as nitrogen, combustible gases such as recycled syngas, carbon dioxide, combustion gas products, e.g., a combustion gas product from the gasifier and/or the combustor, or a combination thereof.

One or more sorbents can also be introduced to the gasifier. The sorbents can capture one or more contaminants from the syngas, such as sodium vapor in the gas phase within the gasifier. The sorbents can be used to dust or coat the particles of the hydrocarbon feedstock prior to introduction to or within the gasifier to reduce the tendency for the hydrocarbon feedstock particles to agglomerate. The sorbents can be ground to an average particle size of about 5 microns to about 100 microns, or about 10 microns to about 75 microns. Illustrative sorbents can include, but are not limited to, carbon rich ash, limestone, dolomite, and coke breeze. Residual sulfur released from the hydrocarbon feedstock can be captured by native calcium in the hydrocarbon feedstock, by a calcium-based sorbent, or a combination thereof to form calcium sulfide.

An illustrative gasification system can include one or more gasifiers, particulate removal systems, first zones or first heat exchangers, and second zones or second heat exchangers. For example, the first zone can be a particulate or fluid/particulate mixture cooling system, and the second zone can be a syngas cooler. The gasification system can also include one or more converters to produce Fischer-Tropsch products, chemicals, and/or feedstocks, including ammonia and methanol. The gasification system can also include one or more hydrogen separators, fuel cells, combustion turbines, steam turbines, waste heat boilers, and generators to produce fuel, power, steam, and/or energy. The gasification system can also include an air separation unit ("ASU") for the production of essentially nitrogen-free syngas.

One or more of the particulates and/or carbon-containing particulates can exit the gasification zone and can be introduced to a first separator where at least a portion of the particulates and/or carbon-containing particulates can be separated therefrom to provide a syngas and separated particulates and/or carbon-containing particulates. In one or more embodiments, all or a portion of the separated particulates and/or carbon-containing particulates can be separated, e.g., as coarse ash and/or carbon-containing coarse ash, and can be recycled to the standpipe. All or a portion of the separated particulates and/or carbon-containing particulates, e.g., all or a portion of the separated coarse ash and/or carbon-containing coarse ash, can be removed from the gasifier for introducing to a combustor. All or a portion of the separated particulates and/or carbon-containing particulates, e.g., all or a portion of the separated coarse ash and/or carbon-containing coarse ash, can be recycled to the standpipe, can be removed from the gasifier for introducing to a combustor, or a combination thereof. Removing particulates and/or carbon-containing particulates, e.g., removing coarse ash and/or carbon-containing coarse ash, from the gasifier can be used to control the height of the particulates and/or carbon-containing particulates within the standpipe and/or the total amount of the particulates and/or carbon-containing particulates within the gasifier. The syngas can be fed to a second separator where a second portion, if any, of the particulates and/or carbon-containing particulates, e.g., coarse ash and/or carbon-containing coarse ash, can be separated therefrom to produce a syngas and separated particulates and/or carbon-containing particulates e.g., separated coarse ash and/or carbon-containing coarse ash, that can be introduced to the standpipe, the combustor, or a combination thereof.

The separators can include any device, system, or combination of devices and/or systems capable of separating or removing at least a portion of the particulates and/or carbon-containing particulates, e.g., coarse ash and/or carbon-containing coarse ash, from the combustion gas, the gasified hydrocarbons or syngas, or any other fluids. Illustrative separators can include, but are not limited to, cyclones, desalters, and/or decanters.

One or more particulate removal systems can be used to partially or completely remove any particulates and/or carbon-containing particulates, e.g., carbon-containing coarse ash and/or carbon-containing fine ash, from the syngas to provide the particulates and/or the carbon-containing particulates and a separated syngas. The particulate removal system can include a separation device for example conventional disengagers and/or cyclones. Particulate control devices ("PCDs") capable of providing an outlet particulate concentration below a detectable limit of about 10 parts per million by weight (ppmw), or below a detectable limit of about 1 ppmw, or below a detectable limit of about 0.1 ppmw can be used. Examples of suitable PCDs can include, but are not limited to, sintered metal filters, metal filter candles, and ceramic filter candles (for example, iron aluminide filter material). The particulates and/or carbon-containing particulates, e.g., carbon-containing coarse ash and/or carbon-containing fine ash, can be recycled to the gasifier, purged from the system, utilized as the particulates and/or carbon-containing particulates, or a combination thereof. At least a portion of the particulates and/or carbon-containing particulates, e.g., carbon-containing coarse ash and/or carbon-containing fine ash, can be introduced to a combusting process to combust at least a portion of the carbon of the carbon-containing particulates.

In an example process, carbon-containing coarse ash can be obtained from one or more separators including, but not limited to, cyclones, desalters, and/or decanters. Carbon-containing fine ash can be obtained from one or more particulate control devices including, but not limited to, sintered metal filters, metal filter candles, and ceramic filter candles (for example, iron aluminide filter material).

All or a portion of the separated particulates and/or carbon-containing particulates, e.g., all or a portion of the separated coarse ash and/or carbon-containing coarse ash, can be introduced to one or more coarse ash heat exchangers to provide for cooled separated particulates and/or carbon-containing particulates, e.g., cooled coarse ash and/or carbon-containing coarse ash, that can be introduced to the combustor. The coarse ash heat exchanger can be an option and all or a portion of the separated particulates and/or carbon-containing particulates, e.g., all or a portion of the separated coarse ash and/or carbon-containing coarse ash, can be directly introduced from the one or more separators to the combustor. The coarse ash heat exchanger can include one or more devices and/or systems suitable for transferring heat from all or a portion of the separated particulates and/or carbon-containing particulates, e.g., all or a portion of the separated coarse ash and/or carbon-containing coarse ash, to produce the separated particulates and/or carbon-containing particulates, e.g., all or a portion of the separated coarse ash and/or carbon-containing coarse ash, having a temperature suitable for introduction to the combustor. The coarse ash heat exchanger can include, but is not limited to, single or multiple pass heat exchange devices such as shell and tube heat exchangers, plate and frame heat exchangers, spiral heat exchangers, bayonet type heat exchangers, U-tube heat exchangers, bare tube coil heat exchangers, extended-surface tube coil heat exchangers, and/or any similar systems and/or devices. Other suitable coarse ash heat exchangers can include vessels or other containers having an internal volume or zone for combining all or a portion of the separated particulates and/or carbon-containing particulates, e.g., all or a portion of the separated coarse ash and/or carbon-containing coarse ash, with a cooling medium, i.e., contact or mixing. The heat recovered from the coarse ash heat exchanger can be utilized to produce a coarse ash heat exchanger steam that can be introduced to a heat exchanger of the combustor to produce the second steam, e.g., a superheated steam. For example, a cooling medium including water can be introduced to the coarse ash heat exchanger for an indirect heat exchange with all or a portion of the separated particulates and/or carbon-containing particulates, e.g., all or a portion of the separated coarse ash and/or carbon-containing coarse ash, to produce a heated medium including a coarse ash heat exchanger steam that can be introduced to a heat exchanger of the combustor to produce the second steam, e.g., a superheated steam.

All or a portion of any remaining particulates and/or carbon-containing particulates, e.g., fine ash and/or carbon-containing fine ash, in the syngas can be removed from the one or more particulate control devices (PCDs). All or a portion of any remaining particulates and/or carbon-containing particulates, e.g., fine ash and/or carbon-containing fine ash, can be introduced to one or more fine ash heat exchangers to provide for cooled remaining particulates and/or carbon-containing particulates, e.g., cooled fine ash and/or carbon-containing fine ash, that can be introduced to the combustor. The fine ash heat exchanger can be an option and all or a portion of any remaining particulates and/or carbon-containing particulates, e.g., fine ash and/or carbon-containing fine ash, can be directly introduced from the one or more particulate control devices (FCDs) to the combustor. The fine ash heat exchanger can include one or more devices and/or systems suitable for transferring heat from all or a portion of any remaining particulates and/or carbon-containing particulates, e.g., all or a portion of any remaining fine ash and/or carbon-containing fine ash, to produce all or a portion of any remaining particulates and/or carbon-containing particulates, e.g., all or a portion of any remaining fine ash and/or carbon-containing fine ash, having a temperature suitable for introduction to the combustor. The one or more fine ash heat exchangers can be similar to the one or more coarse ash heat exchangers described above. The fine ash heat exchanger can include, but is not limited to, single or multiple pass heat exchange devices such as shell and tube heat exchangers, plate and frame heat exchangers, spiral heat exchangers, bayonet type heat exchangers, U-tube heat exchangers, bare tube coil heat exchangers, extended-surface tube coil heat exchangers, and/or any similar systems and/or devices. Other suitable fine ash heat exchangers can include vessels or other containers having an internal volume or zone for combining all or a portion of any remaining particulates and/or carbon-containing particulates, e.g., all or a portion of any remaining fine ash and/or carbon-containing fine ash, with a cooling medium, i.e., contact or mixing. The heat recovered from the fine ash heat exchanger can be utilized to produce a fine ash heat exchanger steam that can be introduced to a heat exchanger of the combustor to produce the second steam e.g., a superheated steam. For example, a cooling medium including water can be introduced to the fine ash heat exchanger for an indirect heat exchange with all or a portion of any remaining particulates and/or carbon-containing particulates, e.g., all or a portion of any remaining fine ash and/or carbon-containing fine ash, to produce a heated medium including a fine ash heat exchanger steam that can be introduced to a heat exchanger of the combustor to produce the second steam, e.g., a superheated steam.

The syngas can be introduced to one or more syngas heat exchangers to produce a syngas having a temperature suitable for introduction to the one or more particulate control devices (PCDs), e.g., during start-up of the gasifying process. The syngas heat exchanger can include one or more devices and/or systems suitable for transferring heat from the syngas to produce a syngas having a temperature suitable for introduction to the one or more PCDs. The syngas heat exchanger can include, but is not limited to, single or multiple pass heat exchange devices such as shell and tube heat exchangers, plate and frame heat exchangers, spiral heat exchangers, bayonet type heat exchangers, U-tube heat exchangers, bare tube coil heat exchangers, extended-surface tube coil heat exchangers, and/or any similar systems and/or devices. Other suitable syngas heat exchangers can include vessels or other containers having an internal volume or zone for combining the syngas with a cooling medium, i.e., contact or mixing. Preferably, the temperature of the syngas can be maintained at a sufficient temperature to prevent and/or reduce condensation of any steam that may be present in the syngas. The temperature of the syngas can also be maintained at a sufficient temperature to prevent and/or reduce the possibility or likelihood of oxidation occurring in the one or more PCDs should oxygen be present in the syngas. The heat recovered from the syngas heat exchanger can be utilized to produce a syngas heat exchanger steam that can be introduced to a heat exchanger of the combustor to produce the second steam, e.g., a superheated steam. For example, a cooling medium including water can be introduced to the syngas heat exchanger for an indirect heat exchange with the syngas to produce a heated medium including a syngas heat exchanger steam that can be introduced to a heat exchanger of the combustor to produce the second steam, e.g., a superheated steam.

Recycled syngas from the gasifier, e.g., a syngas recycled from downstream of the gasifier, can be introduced to a heat exchanger of the combustor and/or reused as an aeration and/or transport gas for the gasifier. For example, at least a portion of the syngas obtained from the one or more particulate control devices (PCDs) can be recycled and directly introduced to a heat exchanger of the combustor and/or the gasifier as recycled syngas. In one or more embodiments, the recycled syngas can be introduced to one or more recycled syngas heat exchangers to provide a cooled recycled syngas. The one or more recycled syngas heat exchangers can be similar to the syngas heat exchangers described above. The recycled syngas heat exchanger can include one or more devices and/or systems suitable for transferring heat from the recycled syngas to produce a recycled syngas having a temperature suitable for introduction to a heat exchanger of the combustor. The recycled syngas heat exchanger can include, but is not limited to, single or multiple pass heat exchange devices such as shell and tube heat exchangers, plate and frame heat exchangers, spiral heat exchangers, bayonet type heat exchangers, U-tube heat exchangers, bare tube coil heat exchangers, extended-surface tube coil heat exchangers, and/or any similar systems and/or devices. Other suitable recycled syngas heat exchangers can include vessels or other containers having an internal volume or zone for combining the recycled syngas with a cooling medium, i.e., contact or mixing. Preferably, the temperature of the recycled syngas can be maintained at a sufficient temperature to prevent and/or reduce condensation of any steam that may be present in the recycled syngas. The heat recovered from the recycled syngas heat exchanger can be utilized to produce a recycled syngas heat exchanger steam that can be introduced to a heat exchanger of the combustor to produce the second steam, e.g., a superheated steam. For example, a cooling medium including water can be introduced to the recycled syngas heat exchanger for an indirect heat exchange with the recycled syngas to produce a heated medium including a recycled syngas heat exchanger steam that can be introduced to a heat exchanger of the combustor to produce the second steam, e.g., a superheated steam. The recycled syngas heat exchanger can cool the recycled syngas to a temperature sufficient to condense at least a portion of any water contained therein. As such, should the recycled syngas contain any steam and/or water vapor, at least a portion of the steam and/or water vapor can be condensed.

The cooled recycled syngas can be introduced to one or more separators where at least a portion of the condensed water, if any, can be separated and recovered. The separator can be a column containing trays, rings, balls, or saddles in any frequency and/or combination. The separator can be a partially or completely empty column. The separator can include one or more adsorbent and/or absorbent materials capable of removing water from the cooled recycled syngas.

A dried recycled syngas containing less water vapor than the recycled syngas introduced to the separator can be recovered from the separator and fed to one or more recycle compressors to produce a compressed recycled syngas. The dried recycled syngas can contain about 20 wt % or less, about 17 wt % or less, about 14 wt % or less, about 12 wt % or less, about 10 wt % or less, about 7 wt % or less, about 5 wt % or less, about 3 wt % or less, about 2 wt % or less, about 1 wt % or less, or about 0.5 wt % or less water. The compressed recycled syngas can be introduced to a heat exchanger of the combustor to produce a heated recycled syngas. At least a portion of the recycled syngas can be introduced to the gasifier to provide at least a portion of the motive fluid and/or aeration fluid for circulating the particulates and/or carbon-containing particulates therein. At least a portion of the recycled syngas can be used to convey, e.g., pneumatically convey, the hydrocarbon feedstock and/or the dried hydrocarbon feedstock into the gasifier.

The one or more recycle compressors can include any type of compressor or combination of compressors. Examples of a suitable recycle compressor include, but are not limited to, centrifugal compressors, axial compressors, rotary positive displacement compressors, diagonal or mixed-flow compressors, reciprocating compressors, dry screw compressors, oil flooded screw compressors, and scroll compressors. The recycle compressor can include one or more compression stages. For example, the recycle compressor can be a two stage or a three stage compressor. If the recycle compressor includes two or more compressors, the two or more compressors can be the same type of compressor or different.

One or more valves or other flow restricting devices can be used to control or adjust the amount of the various flows, e.g., the first oxidant, the heated first oxidant, the second oxidant, the start-up combustion gas, the start-up medium, the atomizing stream, e.g., the atomizing steam, the supplemental fuel, the boiler feed water, the first steam from the combustor, the first steam from the combustor introduced to the gasifier, the first steam from the combustor exported to one or more processes external to the gasifier, the recycled syngas, the heated recycled syngas, the third oxidant to the combustor, the steam introduced to the combustor, the second steam from the combustor, the second steam from the combustor introduced to the gasifier, the second steam from the combustor exported to one or more processes external to the gasifier, the hydrocarbon feedstock, the hot gas product or syngas, the one or more motive fluids and/or aeration fluids, the particulates, and/or the carbon-containing particulates.

The various combusting process flows, e.g., the first oxidant, the third oxidant, the supplemental fuel, the atomizing stream, e.g., the atomizing steam, the particulates and/or the carbon-containing particulates, the boiler feed water, the recycled syngas, and/or the steam can be introduced to the combusting process, e.g., to the combustor, continuously, intermittently, simultaneously, separately, sequentially, or a combination thereof. The various gasifying process flows, e.g., the heated first oxidant, the second oxidant, the start-up combustion gas, the start-up medium, the first steam, the heated recycled syngas, the second steam, the hydrocarbon feedstock, the one or more motive fluids and/or aeration fluids, the particulates and/or the carbon-containing particulates can be introduced to the gasifying process, e.g., to the gasifier, continuously, intermittently, simultaneously, separately, sequentially, or a combination thereof.

The syngas can contain about 85 vol % or more carbon monoxide and hydrogen with the balance being primarily carbon dioxide and methane. The syngas can contain about 90 vol % or more carbon monoxide and hydrogen, about 95 vol % or more carbon monoxide and hydrogen, about 97 vol % or more carbon monoxide and hydrogen, or about 99 vol % or more carbon monoxide and hydrogen. The carbon monoxide content of the syngas can range from a low of about 10 vol %, about 20 vol %, or about 30 vol % to a high of about 50 vol %, about 70 vol %, or about 85 vol %. The hydrogen content of the syngas can range from a low of about 1 vol %, about 5 vol %, or about 10 vol % to a high of about 30 vol %, about 40 vol %, or about 50 vol %. For example, the hydrogen content of the syngas can range from about 20 vol % to about 30 vol %.

The syngas can contain less than about 25 vol %, less than about 20 vol %, less than about 15 vol %, less than about 10 vol %, or less than about 5 vol % of combined nitrogen, methane, carbon dioxide, water, hydrogen sulfide, and hydrogen chloride. The carbon dioxide content of the syngas can be about 25 vol % or less, about 20 vol % or less, about 15 vol % or less, about 10 vol % or less, about 5 vol % or less, about 3 vol % or less, about 2 vol % or less, or about 1 vol % or less. The methane content of the syngas can be about 15 vol % or less, about 10 vol % or less, about 5 vol % or less, about 3 vol % or less, about 2 vol % or less, or about 1 vol % or less. The water content of the syngas can be about 40 vol % or less, about 30 vol % or less, about 25 vol % or less, about 20 vol % or less, about 15 vol % or less, about 10 vol % or less, about 5 vol % or less, about 3 vol % or less, about 2 vol % or less, or about 1 vol % or less. The syngas can be nitrogen-free or essentially nitrogen-free. For example, the syngas can contain less than about 3 vol %, less than about 2 vol %, less than about 1 vol %, or less than about 0.5 vol % nitrogen.

The syngas can have a heating value, corrected for heat loss and dilution effects, of about 1,863 kJ/$m^3$ to about 2,794 kJ/$m^3$, about 1,863 kJ/$m^3$ to about 3,726 kJ/$m^3$, about 1,863 kJ/$m^3$ to about 4,098 kJ/$m^3$, about 1,863 kJ/$m^3$ to about 5,516 kJ/$m^3$, about 1,863 kJ/$m^3$ to about 6,707 kJ/$m^3$, about 1,863 kJ/$m^3$ to about 7,452 kJ/$m^3$, about 1,863 kJ/$m^3$ to about 9,315 kJ/$m^3$, about 1,863 kJ/$m^3$ to about 10,264 kJ/$m^3$, about 1,863 kJ/$m^3$ to about 11,178 kJ/$m^3$, about 1,863 kJ/$m^3$ to about 13,041 kJ/$m^3$, or about 1,863 kJ/$m^3$ to about 14,904 kJ/$m^3$.

The syngas can be further processed according to any desired manner. For example, at least a portion of the syngas can be directed to a gas or combustion turbine which can be coupled to a generator to produce electrical power. In another example, at least a portion of the syngas can be used to produce a hydrogen product. In another example, at least a portion of the syngas can be directed to one or more gas converters to produce one or more Fisher-Tropsch products, methanol, ammonia, chemicals, hydroformylation products, and/or feedstocks, derivatives thereof, and/or combinations thereof.

The separated syngas can be cooled in one or more syngas coolers. For example, the syngas can be cooled to about 538° C. or less, about 482° C. or less, about 427° C. or less, about 371° C. or less, about 316° C. or less, about 260° C. or less, about 204° C. or less, or about 149° C. or less. The separated and/or cooled syngas can be treated within a gas purification system to remove contaminants. The gas purification system can include a system, a process, or a device to remove sulfur and/or sulfur-containing compounds from the syngas. Examples of a suitable catalytic gas purification system include, but are not limited to, systems using zinc titanate, zinc ferrite, tin oxide, zinc oxide, iron oxide, copper oxide, cerium oxide, or mixtures thereof. Examples of a suitable process-based gas purification system include, but are not limited to, the SELEXOL® process, the RECTISOL® process, the CRYSTASULF® process, and the Sulfinol gas treatment process.

One or more amine solvents such as methyl-diethanolamine (MDEA) can be used to remove acid gas from the syngas. Physical solvents, for example SELEXOL® (dimethyl ethers of polyethylene glycol) or RECTISOL® (cold methanol), can also be used. If the syngas contains carbonyl sulfide (COS), the carbonyl sulfide can be converted by hydrolysis to hydrogen sulfide by reaction with water over a catalyst and then absorbed using the methods described above. If the syngas contains mercury, the mercury can be removed using a bed of sulfur-impregnated activated carbon.

One or more catalysts, such as a cobalt-molybdenum (Co—Mo) catalyst can be incorporated into the gas purification system to perform a sour shift conversion of the syngas. The Co—Mo catalyst can operate at a temperature of about 288° C. in the presence of $H_2S$, for example, about 100 parts per million by weight (ppmw) $H_2S$. If a Co—Mo catalyst is used to perform a sour shift, subsequent downstream removal of sulfur can be accomplished using any of the above described sulfur removal methods and/or techniques.

The syngas from the gas purification system can be combusted to produce or generate power and/or steam. The syngas can be sold as a commodity. The syngas can be used to produce Fischer-Tropsch products, chemicals, and/or feedstocks. Hydrogen can be separated from the syngas and used in hydrogenation processes, fuel cell energy processes, ammonia production, and/or as a fuel. Carbon monoxide can be separated from the syngas and used for the production of chemicals, for example, acetic acid, phosgene/isocyanates, formic acid, and propionic acid.

One or more gas converters can be used to convert the syngas into one or more Fischer-Tropsch products, chemicals, and/or feedstocks. The gas converter can include a shift reactor to adjust the hydrogen to carbon monoxide ratio ($H_2$:CO) of the syngas by converting CO to $CO_2$. Within the shift reactor, a water-gas shift reaction reacts at least a portion of the carbon monoxide in the syngas with water in the presence of a catalyst and a high temperature to produce hydrogen and carbon dioxide. Examples of a suitable shift reactor can include, but are not limited to, single stage adiabatic fixed bed reactors, multiple-stage adiabatic fixed bed reactors with interstage cooling, steam generation or cold quench reactors, tubular fixed bed reactors with steam generation or cooling, fluidized bed reactors, or any combination thereof. A sorption enhanced water-gas shift (SEWGS) process, utilizing a pressure swing adsorption unit having multiple fixed bed reactors packed with shift catalyst and at high temperature, e.g., a carbon dioxide adsorbent at about 480° C., can be used. Various shift catalysts can be employed.

The shift reactor can include two reactors arranged in series. A first reactor can be operated at high temperature (about 340° C. to about 400° C.) to convert a majority of the CO present in the syngas to $CO_2$ at a relatively high reaction rate using an iron-chrome catalyst. A second reactor can be operated at a relatively low temperature (about 145° C. to about 205° C.) to complete the conversion of CO to $CO_2$ using a mixture of copper oxide and zinc oxide.

The recovered carbon dioxide from the shift reactor can be used in a fuel recovery process to enhance the recovery of oil and gas. In an illustrative oil recovery process, carbon dioxide can be injected and flushed into an area beneath an existing well where "stranded" oil exists. The water and carbon dioxide removed with the crude oil can then be separated and recycled.

The gas converter can be used to produce one or more Fischer-Tropsch products. The one or more Fischer-Tropsch products can include, but are not limited to, one or more hydrocarbons having a wide range of molecular weights, spanning from light gaseous hydrocarbons (C1-C4), naphtha (C5-C10), diesel (C11-C20), and wax (>C20), derivatives thereof, or combinations thereof. Illustrative Fischer-Tropsch products can include, but are not limited to, diesel fuels, kerosene, aviation fuels, propane, butane, liquefied petroleum gas (LPG), lubricants, naphtha, gasoline, detergents, waxes, lubricants, refinery/petrochemical feedstocks, other transportation fuels, synthetic crude oil, liquid fuels, alpha olefins, derivatives thereof, mixtures thereof, or combinations thereof. The reaction can be carried out in any type reactor, for example, fixed bed, moving bed, fluidized bed, slurry, or bubbling bed using copper, ruthenium, iron or cobalt based catalysts, or combination thereof, under conditions ranging from about 190° C. to about 450° C. depending on the reactor configuration.

The Fischer-Tropsch products are liquids which can be shipped to a refinery site for further chemically reacting and upgrading to a variety of products. Certain products, for example C4-C5 hydrocarbons, can be high quality paraffin solvents which, if desired, can be hydrotreated to remove olefin impurities, or employed without hydrotreating to produce a wide variety of wax products. C16+ liquid hydrocarbon products can be upgraded by various hydroconversion reactions, for example, hydrocracking, hydroisomerization catalytic dewaxing, isodewaxing, or combinations thereof, to produce mid-distillates, diesel and jet fuels for example low freeze point jet fuel and high cetane jet fuel, isoparaffinic solvents, lubricants, for example, lube oil blending components and lube oil base stocks suitable for transportation vehicles, non-toxic drilling oils suitable for use in drilling muds, technical and medicinal grade white oil, chemical raw materials, and various specialty products.

The gas converter can include a slurry bubble column reactor to produce a Fischer-Tropsch product. The slurry bubble column reactor can operate at a temperature of less than about 220° C. and from about 69 kPa to about 4,137 kPa, or about 1,724 kPa to about 2,413 kPa using a cobalt catalyst promoted with rhenium and supported on titania having a Re:Co weight ratio in a range of about 0.01 to about 1 and containing from about 2% wt to about 50% wt cobalt. The catalyst within the slurry bubble column reactor can include, but is not limited to, a titania support impregnated with a salt of a catalytic copper or an Iron Group metal, a polyol or polyhydric alcohol and, optionally, a rhenium compound or salt. Examples of suitable polyols or polyhydric alcohols include, but are not limited to, glycol, glycerol, derythritol, threitol, ribitol, arabinitol, xylitol, ailitol, dulcitol, gluciotol, sorbitol, and mannitol. The catalytic metal, copper or Iron Group metal as a concentrated aqueous salt solution, for example cobalt nitrate or cobalt acetate, can be combined with the polyol and optionally perrhenic acid while adjusting the amount of water to obtain 15 wt % metal, for example, 15 wt % cobalt, in the solution and using optionally incipient wetness techniques to impregnate the catalyst onto rutile or anatase titania support, optionally spray-dried and calcined. This method reduces the need for rhenium promoter.

The gas converter can be used to produce methanol, alkyl formates, dimethyl ether, ammonia, acetic anhydride, acetic acid, methyl acetate, acetate esters, vinyl acetate and polymers, ketones, formaldehyde, dimethyl ether, olefins, derivatives thereof, and/or combinations thereof. For methanol production, for example, the Liquid Phase Methanol Process can be used (LPMeOHT™). In this process, the carbon monoxide in the syngas can be directly converted into methanol using a slurry bubble column reactor and catalyst in an inert hydrocarbon oil reaction medium which can conserve heat of reaction while idling during off-peak periods for a substantial amount of time while maintaining good catalyst activity. Gas phase processes for producing methanol can also be used. For example, known processes using copper-based catalysts can be used. For alkyl formate production, for example, methyl formate, any of several processes wherein carbon monoxide and methanol are reacted in either the liquid or gaseous phase in the presence of an alkaline catalyst or alkali or alkaline earth metal methoxide catalyst can be used. The methanol can be used as produced and/or further processed to provide one or more additional products. Additional products produced from methanol can include, but are not limited to, dimethyl ether (DME), formalin, acetic acid, formaldehyde, methyl-tertiary butyl ether, methylamines, methyl methacrylate, dimethyl terephthalate, methyl mercaptan, methyl chloride, methyl acetate, acetic anhydride, ethylene, propylene, polyolefins, derivatives thereof, mixtures thereof, or combinations thereof.

For ammonia production, the gas converter can be adapted to operate known processes to produce ammonia. The ammonia product can be used as produced and/or further processed to provide one or more additional products. Additional products that can be produced, at least in part, from ammonia can include, but are not limited to, urea, ammonium salts, ammonium phosphates, nitric acid, acrylonitrile, and amides.

Carbon dioxide can be separated and/or recovered from the syngas. Physical adsorption techniques can be used. Examples of suitable adsorbents and techniques can include, but are not limited to, propylene carbonate physical adsorbent solvent as well as other alkyl carbonates, dimethyl ethers of polyethylene glycol of two to twelve glycol units (Selexol™ process), n-methyl-pyrrolidone, sulfolane, use of the Sulfinol® Gas Treatment Process, and use of methanol, e.g., the RECTISOL® process.

At least a portion of the syngas can be sold or upgraded using further downstream processes. At least a portion of the syngas can be directed to a hydrogen separator. At least a portion of the syngas can bypass the gas converter described above and can be fed directly to the hydrogen separator.

The hydrogen separator can include any system or device to selectively separate hydrogen from syngas to provide a purified hydrogen stream and a waste gas stream. The hydrogen separator can provide a carbon dioxide rich fluid and a hydrogen rich fluid. At least a portion of the hydrogen rich fluid can be used as a feed to a fuel cell and at least a portion of the hydrogen rich fluid can be combined with the syngas prior to use as a fuel in a combustor. The hydrogen separator can utilize pressure swing absorption, cryogenic distillation, and/or semi-permeable membranes. Examples of suitable absorbents include, but are not limited to, caustic soda, potassium carbonate or other inorganic bases, and/or alkanolamines.

At least a portion of the syngas can be combusted in a combustor to provide a high pressure/high temperature exhaust gas stream. The high pressure/high temperature exhaust gas stream can be introduced to a combustion turbine to provide an exhaust gas stream and mechanical shaft power to drive an electric generator. The exhaust gas stream can be introduced to a heat recovery system to provide steam. A first portion of the steam can be introduced to a steam turbine to provide mechanical shaft power to drive an electric generator. A second portion of the steam can be introduced to the gasifier, and/or other auxiliary process equipment. Lower pressure steam from the steam turbine can be recycled to the heat recovery system.

Oxygen enriched air or essentially oxygen from one or more air separation units (ASU) can be supplied to the gasifier. The ASU can provide a nitrogen-lean and oxygen-rich stream to the gasifier, thereby minimizing the nitrogen concentration in the system. The use of a nearly pure oxygen stream allows the gasifier to produce a syngas that is essentially nitrogen-free, for example, containing less than 0.5% nitrogen/argon. The ASU can be a high-pressure, cryogenic type separator that can be supplemented with air. A reject nitrogen stream from the ASU can be added to a combustion turbine or used as utility. For example, up to about 10 vol %, or up to about 20 vol %, or up to about 30 vol %, or up to about 40 vol %, or up to about 50 vol %, or up to about 60 vol %, or up to about 70 vol %, or up to about 80 vol %, or up to about 90 vol %, or up to about 100 vol % of the total gasification oxidant fed to the gasifier can be supplied by the ASU.

Illustrative systems and methods for further processing at least a portion of the syngas can be as discussed and described in U.S. Pat. Nos. 7,932,296; 7,722,690; 7,687,041; and 7,138,001 and U.S. Patent Application Publication Nos.: 2009/0294328; 2009/0261017; 2009/0151250; and 2009/0064582.

FIG. 1 depicts an illustrative gasification system 100 for gasifying one or more hydrocarbon feedstocks, according to one or more embodiments. The gasification system 100 can include a combustion zone 102 or two or more combustion zones arranged in series or parallel (not shown). The gasification system 100 can also include a gasification zone 104 or two or more gasification zones arranged in series or parallel (not shown). During operation, a syngas via line 106 and a carbon-containing coarse ash via line 108 can be recovered from the gasification zone 104. A carbon-containing fine ash via line 110 can be recovered from the syngas in one or more processes for separating the carbon-containing fine ash from the syngas (e.g., a particulate control process, not shown) downstream of the gasification zone 104. At least a portion of the carbon-containing coarse ash via line 108, at least a portion of the carbon-containing fine ash via line 110, or a combination thereof can be introduced to the combustion zone 102. While the carbon-containing coarse ash via line 108 and/or the carbon-containing fine ash via line 110 can be introduced separately to the combustion zone 102, the carbon-containing coarse ash via line 108 and the carbon-containing fine ash via line 110 can be combined in line 112 and introduced to the combustion zone 102 as a combined stream. At least a portion of the carbon of the one or more carbon-containing coarse ash and/or the carbon-containing fine ash via line 112 can be combusted in the combustion zone 102 with an oxidant (third oxidant) via line 114 to produce a combustion gas (second combustion gas) via line 116. When additional combustion in the combustion zone 102 is desired, a supplemental fuel can be introduced via line 117 to the combustion zone 102. An atomizing stream, e.g., an atomizing steam, can be introduced via line 118 to the combustion zone 102. Slagging can occur in the combustion zone 102. Optionally, at least a portion of the slag can be removed from the combustion zone 102 via line 119. Combustion gas via line 116 can be introduced to one or more processes (not shown) external to the gasification zone 104, e.g., drying a moisture-containing hydrocarbon feedstock to produce a dried hydrocarbon feedstock prior to introducing the dried hydrocarbon feedstock to the gasification zone 104.

The combustion zone 102, the combustion gas via line 116, or a combination thereof can be utilized for one or more processes external to the gasification zone 104. A boiler feed water can be introduced via line 120 to the combustion zone 102 to produce a boiler feed water steam (first steam) via line 122. The first steam can be introduced via line 124 to the gasification zone 104, the first steam can be exported via line 126 to a process (e.g., supplying the first steam to a steam turbine to produce electrical power, not shown) external to the gasification zone 104, the first steam via lines 122 and/or 126 can be introduced via line 133 to the combustion zone 102, or a combination thereof. A syngas, e.g., recycled syngas from a process (not shown) downstream of the gasification zone 104, can be introduced via line 128 to the combustion zone 102 to produce a heated syngas, e.g., a heated recycled syngas, via line 130 that can be introduced via line 130 to the gasification zone 104. A first oxidant can be introduced via line 132 to the combustion zone 102 to produce a heated first oxidant via line 134 that can be introduced via line 134 to the gasification zone 104. A steam, e.g., steam from the combustion zone 102, e.g., first steam produced from the boiler feed water via line 122 and/or line 126, steam from a process downstream of the gasification zone 104, e.g., syngas heat exchanger steam produced by heat recovery from the syngas in line 106 via a syngas heat exchanger (not shown), recycled syngas heat exchanger steam produced via a recycled syngas heat exchanger (not shown), coarse ash heat exchanger steam produced via a coarse ash heat exchanger (not shown), fine ash heat exchanger steam produced via a fine ash heat exchanger (not shown), or a combination thereof can be introduced via line 133 to the combustion zone 102 to produce a second steam via line 135. The second steam via line 135 can be a superheated steam. The second steam can be introduced via line 136 to the gasification zone 104, the second steam can be exported via line 137 to a process (e.g., supplying the second steam to a steam turbine to produce electrical power, not shown) external to the gasification zone 104, or a combination thereof.

Figure 2:
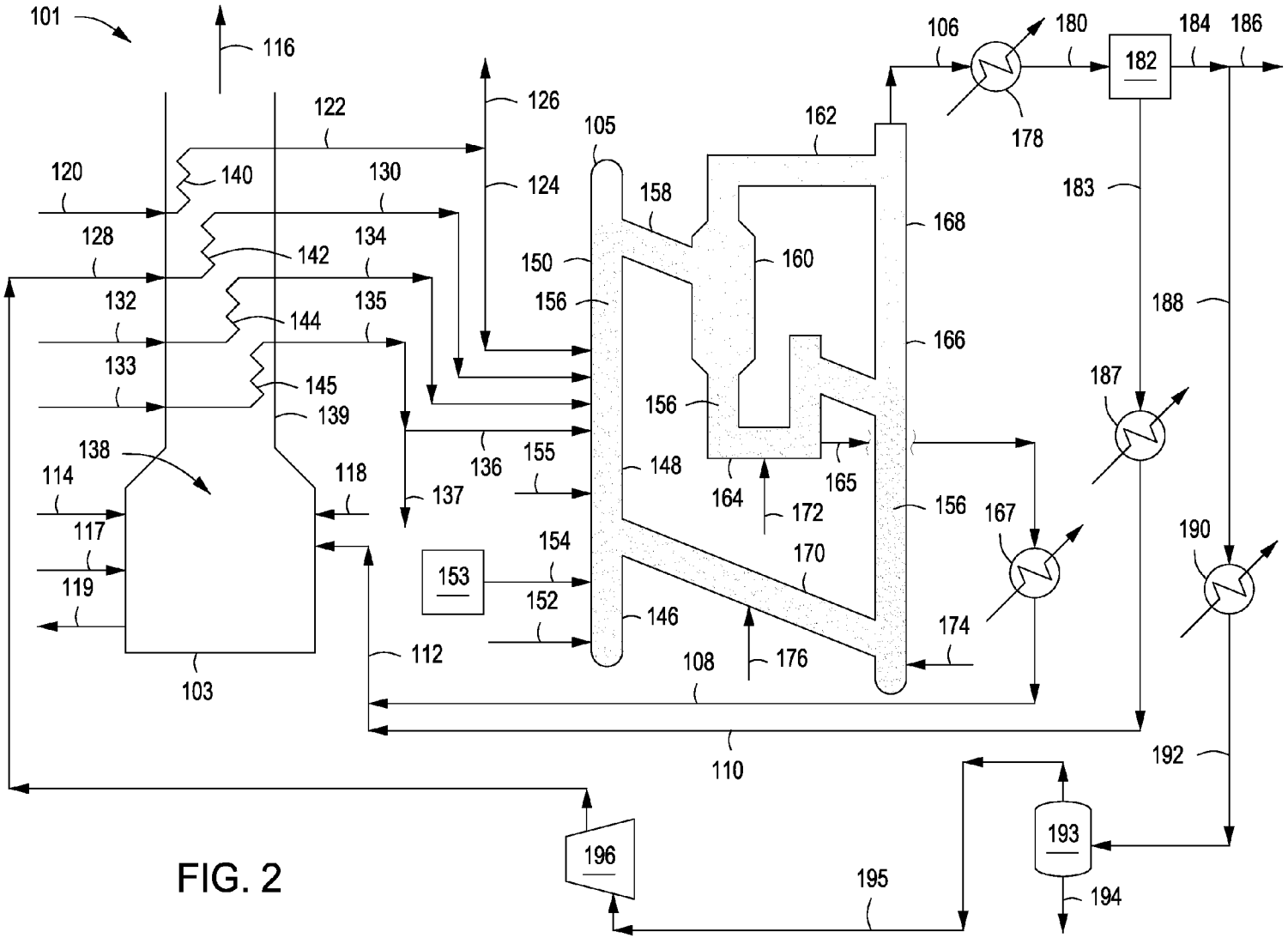
FIG. 2 depicts another illustrative gasification system for gasifying a hydrocarbon feedstock, according to one or more embodiments described.

FIG. 2 depicts an illustrative gasification system 101 for gasifying one or more hydrocarbon feedstocks, according to one or more embodiments. The gasification system 101 can be as generally described herein with regard to FIG. 1. The gasification system 101 can include a single combustor 103 or two or more combustors arranged in series or parallel (not shown). The gasification system 101 can also include a single gasifier 105 or two or more gasifiers arranged in series or parallel (not shown). The gasification system 101 can also include one or more heat exchanger "coolers" and/or "heaters" (four are shown 167, 178, 187, 190), one or more particulate control devices (PCDs) (one is shown 182), one or more separators (one is shown 193) and one or more compressors or "recycle compressors" (one is shown 196).

Each gasifier 105 can include one or more mixing or introduction zones (two are shown 146 and 148), one or more risers or gasification zones 150, one or more disengagers or separators (two are shown 160 and 168), one or more standpipes 166, and one or more transfer lines (four are shown 158, 162, 164, 170). If the gasification system 101 includes two or more gasifiers 105, each gasifier 105 can be configured independent from the others or configured where any of the one or more mixing zones 146, 148; gasification zones 150; separators 160, 168; and standpipes 166 can be shared. For simplicity and ease of description, embodiments of the gasification system 101 will be further described in the context of a single reactor train.

The combustor 103 can include any combustion device, system, or combination of devices and/or systems capable of at least partially combusting at least a portion of the carbon of the one or more carbon-containing particulates. The combustor 103 can include a refractory lined chamber that includes one or more burner nozzles (not shown) where a mixture of the one or more carbon-containing particulates introduced via line 112 to the combustor 103 together with a combustion oxidant (third oxidant) introduced via line 114, and optionally, an atomizing stream, e.g., an atomizing steam, introduced via line 118, and optionally, when additional combustion is desired, a supplemental fuel introduced via line 117 can be introduced to a combustion zone 138 of the combustor 103 and combusted to produce a flow of a combustion gas (second combustion gas) or exhaust gas 116. For example, the combustor 103 can include one or more combustion zones 138, with or without a refractory lining, one or more exhaust ducts or channels 139, and one or more heat exchangers (four are shown 140, 142, 144, 145).

The combustor 103 can at least partially combust at least a portion of the carbon of the one or more carbon-containing particulates introduced via line 112 in the presence of the third oxidant introduced via line 114 and optionally, an atomizing stream, e.g., an atomizing steam, introduced via line 118, and optionally, when additional combustion is desired, a supplemental fuel introduced via line 117, within the combustion zone 138 to produce the second combustion gas or exhaust gas 116. Although not shown, in another example, the combustor 103 can include a mixing zone for mixing the one or more carbon-containing particulates, third oxidant, and optionally an atomizing stream, e.g., an atomizing steam, and supplemental fuel, and a combustion zone 138 for at least partially combusting the mixture of the one or more carbon-containing particulates, third oxidant, and optionally an atomizing stream, e.g., an atomizing steam, and supplemental fuel.

The boiler feed water introduced via line 120 can be introduced to the first heat exchanger 140 where heat can be indirectly exchanged between the boiler feed water and the second combustion gas 116 to produce the first steam via line 122. The first steam can be introduced via line 124 to the gasifier 105, can be exported to a process external to the gasifier 105 via line 126, and/or can be introduced to the combustor 103 via line 133. The syngas, e.g., syngas recycled from downstream of the gasifier 105, introduced via line 128 can be introduced to the second heat exchanger 142 where heat can be indirectly exchanged between the recycled syngas and the second combustion gas 116 to produce a heated recycled syngas via line 130 that can be introduced via line 130 to the gasifier 105. The first oxidant introduced via line 132 can be introduced to the third heat exchanger 144 where heat can be indirectly exchanged between the first oxidant and the second combustion gas 116 to produce a heated first oxidant via line 134 that can be introduced via line 134 to the gasifier 105. The steam introduced via line 133 can be introduced to the fourth heat exchanger 145 where heat can be indirectly exchanged between the steam and the second combustion gas 116 to produce the second steam, e.g., a superheated steam, via line 135. The second steam can be introduced via line 136 to the gasifier 105 and/or can be exported to a process external to the gasifier 105 via line 137.

While the four heat exchangers 140, 142, 144, 145 are shown in a specific arrangement, it should be understood that any arrangement of the four heat exchangers can be utilized. For example, the boiler feed water in line 120 can be introduced to the heat exchanger 145 and the steam in line 133 can be introduced to the heat exchanger 140. Also for example, the boiler feed water in line 120 can be introduced to the heat exchanger 144 and the first oxidant in line 132 can be introduced to the heat exchanger 140. Also for example, the boiler feed water in line 120 can be introduced to the heat exchanger 142 and the recycled syngas in line 128 can be introduced to the heat exchanger 140. Also for example, the recycled syngas in line 128 can be introduced to the heat exchanger 145 and the steam in line 133 can be introduced to the heat exchanger 142. Also for example, the recycled syngas in line 128 can be introduced to the heat exchanger 144 and the first oxidant in line 132 can be introduced to the heat exchanger 142. Also for example, the first oxidant in line 132 can be introduced to the heat exchanger 145 and the steam in line 133 can be introduced to the heat exchanger 144.

The first steam via line 124, the heated recycled syngas via line 130, the heated first oxidant via line 134, the second steam via line 136, or a combination thereof can be introduced to the second mixing zone 148 of the gasifier 105. The first steam, the heated recycled syngas, the heated first oxidant, the second steam, or a combination thereof can be mixed or otherwise combined to form a fluid mixture prior to introduction to the gasifier 105. Although the first steam, the heated recycled syngas, the heated first oxidant, and the second steam via lines 124, 130, 134, 136, respectively, are illustrated as being fed to the second mixing zone 148, it should be understood that the first steam, the heated recycled syngas, the heated first oxidant, and/or the second steam can be introduced to the first mixing zone 146, the second mixing zone 148, the gasification zone or riser 150, the transfer line 158, 162, 164 and/or 170, the standpipe 166, or a combination thereof.

A second oxidant can be introduced via line 152 to the first mixing zone 146 of the gasifier 105. The second oxidant introduced via line 152 can be in addition to or in lieu of the heated first oxidant introduced via line 134 to the second mixing zone 148 of the gasifier 105. Also for example, the second oxidant via line 152 and the heated first oxidant via line 134 can be mixed or otherwise combined to form a gasification oxidant mixture prior to introduction to the first mixing zone 146 of the gasifier 105, the second mixing zone 148 of the gasifier 105, or a combination thereof. Although the second oxidant is illustrated as being introduced to the first mixing zone 146 of the gasifier 105 and the heated first oxidant is illustrated as being introduced to the second mixing zone 148 of the gasifier 105, it should be understood that the second oxidant and/or the heated first oxidant can be introduced to the first mixing zone 146, the second mixing zone 148, the gasification zone or riser 150, the transfer line 158, 162, 164 and/or 170, the standpipe 166, or a combination thereof.

The gasification system 101 can also include one or more start-up heaters (one is shown 153). The start-up heater 153 can combust and/or heat one or more start-up fuels and/or inert mediums to provide a start-up combustion gas and/or a start-up medium via line 154 that can assist in the start-up of the gasifier 105. It should be noted that the start-up combustion gas and/or the start-up medium via line 154 can be introduced to one or more locations within the gasifier 105 via line 154 and/or via a plurality of lines 154. Also for example, the combustor 103 can be used in addition to, or in lieu of, the start-up heater 153 to assist in the start-up and/or heat-up of the gasifier 105.

A hydrocarbon feedstock can be introduced via line 155 to the second mixing zone 148 of the gasifier 105. Although the hydrocarbon feedstock via line 155 is illustrated as being introduced to the second mixing zone 148, it should be understood that the hydrocarbon feedstock can be introduced to the first mixing zone 146, the second mixing zone 148, the gasification zone or riser 150, the transfer line 158, 162, 164 and/or 170, the standpipe 166, or a combination thereof.

One or more particulates and/or carbon-containing particulates 156 can exit the gasification zone 150 and can be introduced via transfer line 158 to the first separator 160 where at least a portion of the particulates and/or carbon-containing particulates 156 can be separated therefrom to provide a syngas via transfer line 162 and separated particulates and/or carbon-containing particulates 156 via transfer line 164. In one or more embodiments, all or a portion of the separated particulates and/or carbon-containing particulates 156 can be separated, e.g., as coarse ash and/or carbon-containing coarse ash, and can be recycled via transfer line 164 to the standpipe 166. All or a portion of the separated particulates and/or carbon-containing particulates 156, e.g., all or a portion of the separated coarse ash and/or carbon-containing coarse ash, in transfer line 164 can be removed from the gasifier 105 via line 165. All or a portion of the separated particulates and/or carbon-containing particulates 156, e.g., all or a portion of the separated coarse ash and/or carbon-containing coarse ash, can be introduced via line 165 to a coarse ash heat exchanger 167 to provide for cooled separated particulates and/or carbon-containing particulates, e.g., cooled coarse ash and/or carbon-containing coarse ash, via line 108 that can be introduced to the combustor 103 via line 112.

Coarse ash heat exchanger 167 can be an option and all or a portion of the separated particulates and/or carbon-containing particulates 156, e.g., all or a portion of the separated coarse ash and/or carbon-containing coarse ash, can be directly introduced from the transfer line 164 to the combustor 103 via line 108, e.g., by combining lines 165 and 108, and line 112. The coarse ash heat exchanger 167 can include one or more devices and/or systems suitable for transferring heat from all or a portion of the separated particulates and/or carbon-containing particulates 156, e.g., all or a portion of the separated coarse ash and/or carbon-containing coarse ash, in line 165 to produce all or a portion of the separated particulates and/or carbon-containing particulates, e.g., all or a portion of the separated coarse ash and/or carbon-containing coarse ash, via line 108 having a temperature suitable for introduction to the combustor 103 via line 112. The heat recovered from the coarse ash heat exchanger 167 can be utilized to produce a coarse ash heat exchanger steam that can be introduced to the heat exchanger 145 of the combustor 103 via line 133 to produce the second steam. For example, a cooling medium including water can be introduced to the coarse ash heat exchanger 167 for an indirect heat exchange with all or a portion of the separated particulates and/or carbon-containing particulates 156, e.g., all or a portion of the separated coarse ash and/or carbon-containing coarse ash, in line 165 to produce a heated medium including a coarse ash heat exchanger steam that can be introduced to the heat exchanger 145 of the combustor 103 via line 133 to produce the second steam.

Removing particulates and/or carbon-containing particulates 156, e.g., removing coarse ash and/or carbon-containing coarse ash, via lines 165 and/or 108 from the gasifier 105 can be used to control the height of the particulates and/or carbon-containing particulates within the standpipe 166 and/or the total amount of the particulates and/or carbon-containing particulates within the gasifier 105. The syngas via transfer line 162 can be introduced to the second separator 168 where a second portion, if any, of the particulates and/or carbon-containing particulates 156, e.g., coarse ash and/or carbon-containing coarse ash, can be separated therefrom to produce a syngas via line 106 and separated particulates and/or carbon-containing particulates 156, e.g., coarse ash and/or carbon-containing coarse ash, that can be fed to the standpipe 166.

The separators 160 and 168 can include any device, system, or combination of devices and/or systems capable of separating or removing at least a portion of the particulates and/or carbon-containing particulates from the gasifier combustion gas (first combustion gas), the gasified hydrocarbons or syngas, or any other fluids. Illustrative separators can include, but are not limited to, cyclones, desalters, and/or decanters.

The particulates and/or carbon-containing particulates 156 within the standpipe 166 can be recycled to the gasification zone 150 via transfer or recycle line 170. The recycled particulates and/or carbon-containing particulates can be introduced to the first mixing zone 146, the second mixing zone 148, or, as shown, between the first and second mixing zones 146, 148. As discussed and described above, the particulates and/or carbon-containing particulates 156 can be loaded or otherwise disposed within the gasifier 105 prior to introducing the second oxidant via line 152, the hydrocarbon feedstock via line 155, the first steam via line 124, the heated recycled syngas via line 130, the heated first oxidant via line 134, and/or the second steam via line 136 to the gasifier 105. As such, circulation of the particulates and/or carbon-containing particulates 156 can begin prior to introducing the second oxidant via line 152, the hydrocarbon feedstock via line 155, the first steam via line 124, the heated recycled syngas via line 130, the heated first oxidant via line 134, and/or the second steam via line 136 to the gasifier 105. In another example, additional or make-up particulates and/or carbon-containing particulates 156 can be introduced during introduction of the second oxidant via line 152, the hydrocarbon feedstock via line 155, the first steam via line 124, the heated recycled syngas via line 130, the heated first oxidant via line 134, and/or the second steam via line 136 to the gasifier 105.

One or more circulation or fluidizing fluids via one or more fluid introduction lines (three are shown 172, 174, and 176) can be introduced to the transfer line 164, the standpipe 166, and the recycle line 170, respectively, in order to provide a motive fluid and/or an aeration fluid within the gasifier 105 for circulating the particulates and/or carbon-containing particulates 156 within the gasifier 105. Illustrative fluids introduced via lines 172, 174, 176 can include, but are not limited to, inert gases such as nitrogen, combustible gases such as recycled syngas, carbon dioxide, combustion gas products, e.g., a combustion gas product from the gasifier 105 and/or the combustor 103, or any combination thereof.

The syngas via line 106 can be introduced to the one or more syngas heat exchangers 178 to produce a syngas via line 180 having a temperature suitable for introduction to the one or more particulate control devices (PCDs) 182. The syngas heat exchanger 178 can include one or more devices and/or systems suitable for transferring heat from the syngas in line 106 to produce the syngas via line 180 having a temperature suitable for introduction to the one or more PCDs 182. Preferably, the temperature of the syngas in line 180 can be maintained at a sufficient temperature to prevent and/or reduce condensation of any steam and/or hydrocarbons that may be present in the syngas. The temperature of the syngas in line 180 can also be maintained at a sufficient temperature to prevent and/or reduce the possibility or likelihood of oxidation occurring in the one or more PCDs 182 should oxygen be present in the syngas, e.g., during start-up of the gasifier 105. The heat recovered from the syngas heat exchanger 178 can be utilized to produce a syngas heat exchanger steam that can be introduced to the heat exchanger 145 of the combustor 103 via line 133 to produce the second steam. For example, a cooling medium including water can be introduced to the syngas heat exchanger 178 for an indirect heat exchange with the syngas in line 106 to produce a heated medium including a syngas heat exchanger steam that can be introduced to the heat exchanger 145 of the combustor 103 via line 133 to produce the second steam.

The syngas via line 180 can be introduced to the one or more particulate control devices (PCDs) 182 which can remove all or a portion of any remaining particulates and/or carbon-containing particulates, e.g., fine ash and/or carbon-containing fine ash, contained therein via line 183 to produce a syngas via line 184. The syngas via line 184 can be removed from the gasification system 101 via line 186. At least a portion of the syngas in line 184 can be recycled via line 188 within the gasification system 101 to be utilized, e.g., as a recycled syngas, for introducing to the heat exchanger 142 of the combustor 103 via line 128.

The one or more particulate control devices (PCDs) 182 can include one or more separation devices, for example, conventional disengagers and/or cyclones. Particulate control devices capable of providing an outlet particulate concentration below a detectable limit of about 10 parts per million by weight (ppmw), or below a detectable limit of about 1 ppmw, or below a detectable limit of about 0.1 ppmw can be used. Examples of suitable particulate control devices can include, but are not limited to, sintered metal filters, metal filter candles, and/or ceramic filter candles (for example, iron aluminide filter material).

All or a portion of any remaining particulates and/or carbon-containing particulates, e.g., fine ash and/or carbon-containing fine ash, in the syngas in line 180 can be removed from the one or more particulate control devices (PCDs) 182 via line 183. All or a portion of any remaining particulates and/or carbon-containing particulates, e.g., fine ash and/or carbon-containing fine ash, can be introduced via line 183 to a fine ash heat exchanger 187 to provide for cooled remaining particulates and/or carbon-containing particulates, e.g., cooled fine ash and/or carbon-containing fine ash, via line 110 that can be introduced to the combustor 103 via line 112.

Fine ash heat exchanger 187 can be an option and all or a portion of any remaining particulates and/or carbon-containing particulates, e.g., fine ash and/or carbon-containing fine ash, can be directly introduced from the one or more particulate control devices (PCDs) 182 to the combustor 103 via line 110, e.g., by combining lines 183 and 110, and line 112. The fine ash heat exchanger 187 can include one or more devices and/or systems suitable for transferring heat from all or a portion of any remaining particulates and/or carbon-containing particulates, e.g., all or a portion of any remaining fine ash and/or carbon-containing fine ash, in line 183 to produce all or a portion of any remaining particulates and/or carbon-containing particulates, e.g., all or a portion of any remaining fine ash and/or carbon-containing fine ash, via line 110 having a temperature suitable for introduction to the combustor 103 via line 112. The heat recovered from the fine ash heat exchanger 187 can be utilized to produce a fine ash heat exchanger steam that can be introduced to the heat exchanger 145 of the combustor 103 via line 133 to produce the second steam via line 135. For example, a cooling medium including water can be introduced to the fine ash heat exchanger 187 for an indirect heat exchange with all or a portion of any remaining particulates and/or carbon-containing particulates, e.g., all or a portion of any remaining fine ash and/or carbon-containing fine ash, in line 183 to produce a heated medium including a fine ash heat exchanger steam that can be introduced to the heat exchanger 145 of the combustor 103 via line 133 to produce the second steam via line 135.

The recycled syngas in line 188 can be introduced via line 128 to the heat exchanger 142 of the combustor 103 to produce the heated recycled syngas via line 130. For example, lines 188 and 128 can be combined as one line 128 for a direct introduction of the recycled syngas to the heat exchanger 142 of the combustor 103 to produce the heated recycled syngas via line 130. In one or more embodiments, as shown in FIG. 2, the recycled syngas can be introduced via line 188 to a recycled syngas heat exchanger 190 to provide a cooled recycled syngas via line 192. The recycled syngas heat exchanger 190 can be similar to the syngas heat exchanger 178. The recycled syngas heat exchanger 190 can include one or more devices and/or systems suitable for transferring heat from the recycled syngas in line 188 to produce the recycled syngas via line 192 having a temperature suitable for introduction to the heat exchanger 142 of the combustor 103 via line 128. Preferably, the temperature of the recycled syngas in line 192 can be maintained at a sufficient temperature to prevent and/or reduce condensation of any steam and/or hydrocarbons that may be present in the recycled syngas. The heat recovered from the recycled syngas heat exchanger 190 can be utilized to produce a recycled syngas heat exchanger steam that can be introduced to the heat exchanger 145 of the combustor 103 via line 133 to produce the second steam via line 135. For example, a cooling medium including water can be introduced to the recycled syngas heat exchanger 190 for an indirect heat exchange with the recycled syngas in line 188 to produce a heated medium including a recycled syngas heat exchanger steam that can be introduced to the heat exchanger 145 of the combustor 103 via line 133 to produce the second steam via line 135. The recycled syngas heat exchanger 190 can cool the recycled syngas to a temperature sufficient to condense at least a portion of any water contained therein. As such, should the recycled syngas contain any steam and/or water vapor, at least a portion of the steam and/or water vapor can be condensed.

The cooled recycled syngas via line 192 can be introduced to the one or more separators 193 where at least a portion of the condensed water, if any, can be separated and recovered via line 194. The separator 193 can be a column containing trays, rings, balls, or saddles in any frequency and/or combination. The separator 193 can be a partially or completely empty column. The separator 193 can include one or more adsorbent and/or absorbent materials capable of removing water from the cooled recycled syngas.

A dried recycled syngas via line 195 containing less water vapor than the recycled syngas in line 192 can be recovered from the separator 193 and introduced to a recycle compressor 196 to produce a compressed recycled syngas via line 128. The dried recycled syngas in line 195 can contain about 20 wt % or less, about 17 wt % or less, about 14 wt % or less, about 12 wt % or less, about 10 wt % or less, about 7 wt % or less, about 5 wt % or less, about 3 wt % or less, about 2 wt % or less, about 1 wt % or less, or about 0.5 wt % or less water. The compressed recycled syngas via line 128 can be introduced to the heat exchanger 142 of the combustor 103 to produce the heated recycled syngas via line 130. Although not shown, at least a portion of the recycled syngas can be introduced to the gasifier 105 via lines 172, 174, and/or 176 to provide at least a portion of the motive fluid and/or the aeration fluid for circulating the particulates and/or carbon-containing particulates 156 therein. Also for example, at least a portion of the compressed recycled syngas from the recycle compressor 196 can be used, e.g., directly used, for aeration in the gasifier 105 and/or for conveying the hydrocarbon feedstock and/or the dried hydrocarbon feedstock into the gasifier 105 (not shown).

The one or more recycle compressors 196 can include any type of compressor or combination of compressors. The recycle compressor 196 can include, but is not limited to, centrifugal compressors, axial compressors, rotary positive displacement compressors, diagonal or mixed-flow compressors, reciprocating compressors, dry screw compressors, oil flooded screw compressors, and scroll compressors. The recycle compressor 196 can include one or more compression stages. For example, the recycle compressor 196 can be a two stage or a three stage compressor. If the recycle compressor 196 includes two or more compressors the two or more compressors can be the same type of compressor or different.

The first steam via line 124, the heated recycled syngas via line 130, the heated first oxidant via line 134, and/or the second steam via line 136 can increase the temperature within the gasifier 105 and, if present, the temperature of the particulates and/or carbon-containing particulates 156 circulating therein.

The hydrocarbon feedstock via line 155 can be introduced to the first mixing zone 146, the second mixing zone 148, and/or the gasification zone 150. For example, the hydrocarbon feedstock via line 155 can be introduced to the second mixing zone 148. The heated first oxidant via line 134 and/or the second oxidant via line 152 can also be introduced to the gasifier 105. For example, at least a portion of the carbon of the one or more carbon-containing particulates, e.g., the one or more carbon-containing particulates via the transfer line 170, can be combusted in the presence of the heated first oxidant and/or the second oxidant, thereby producing a first combustion gas and heat. At least a portion of the hydrocarbon feedstock introduced via line 155 can be combusted in the presence of the first combustion gas, e.g., when introducing at least a portion of the hydrocarbon feedstock via line 155 after introducing the heated first oxidant via line 134 and/or the second oxidant via line 152 and combusting at least a portion of the carbon of the one or more carbon-containing particulates. The amount of oxidant within the gasifier 105 available for combusting at least a portion of the carbon of the one or more carbon-containing particulates and/or combusting at least a portion of the hydrocarbon feedstock introduced via line 155 can be controlled by adjusting the amount of the heated first oxidant introduced via line 134 and/or the second oxidant introduced via line 152 to the gasifier 105.

In addition to combusting at least a portion of the carbon of the one or more carbon-containing particulates and/or combusting at least a portion of the hydrocarbon feedstock within the gasifier 105, at least a portion of the hydrocarbon feedstock can be gasified, vaporized, cracked, and/or deposited onto the circulating particulates and/or carbon-containing particulates 156 to produce the first combustion gas, vaporized hydrocarbons, cracked hydrocarbons, and/or carbon-containing particulates. The hot gas product or syngas can be separated from the particulates and/or carbon-containing particulates e.g., coarse ash and/or carbon-containing coarse ash, via the first and second separators 160, 168 and recovered as a hot gas product or syngas via line 106.

For example, if the concentration of the heated first oxidant in line 134 and/or the second oxidant in line 152 is too high, the gasification oxidant content thereof can be diluted to a desired concentration using at least a portion of the first steam in line 124 and/or the second steam in line 136. Also for example, combining the heated first oxidant in line 134 and/or the second oxidant in line 152 with at least a portion of the first steam in line 124 and/or the second steam in line 136 can also increase the temperature of the gasification oxidant introduced to the gasifier 105. Also for example, combining the heated first oxidant in line 134 and/or the second oxidant in line 152 with at least a portion of the first steam in line 124 and/or the second steam in line 136 can also pre-heat the gasification oxidant prior to introduction to the gasifier 105. Also for example, combining the heated first oxidant in line 134 and/or the second oxidant in line 152 with at least a portion of the first steam in line 124 and/or the second steam in line 136 can help prevent the formation of localized overheating at the points of introduction of the heated first oxidant and/or the second oxidant to the gasifier 105. Localized overheating can result in an exceeding of the softening temperature of the particulates and/or carbon-containing particulates that can result in particulate and/or carbon-containing particulate agglomeration that can prevent the circulation of the particulates and/or carbon-containing particulates and can lead to a stoppage of the gasification process.

The cooled syngas via line 180 can be introduced to the one or more particulate control devices 182. As described above, the particulate control device 182 can remove at least a portion of any remaining particulates and/or carbon-containing particulates, e.g., fine ash and/or carbon-containing fine ash, via line 183 to produce a syngas via line 184. The syngas in line 184 can be recovered from the gasification system 101 via line 186. The syngas in line 184 can be recycled via line 188 within the gasification system 101. A portion of the syngas via line 184 can be recovered via line 186 from the gasification system 101, a portion of the syngas via line 184 can be recycled via line 188 within the gasification system 101, or a combination thereof. Recycle of the syngas via line 188 and/or line 128 can be stopped, not initiated to begin with, and/or decreased and/or stopped over a period of time.

Introduction of the first steam via line 124, the heated recycled syngas via line 130, the heated first oxidant via line 134, the second steam via line 136, and/or the second oxidant via line 152 can be stopped before, when, or after introduction of the hydrocarbon feedstock via line 155 begins. Introduction of the first steam via line 124, the heated recycled syngas via line 130, the heated first oxidant via line 134, the second steam via line 136, and/or the second oxidant via line 152 can be stopped over a short period of time, e.g., less than about a minute, or gradually over an extended period of time, e.g., minutes, tens of minutes, or even hours. As such, stopping the introduction of the first steam via line 124, the heated recycled syngas via line 130, the heated first oxidant via line 134, the second steam via line 136, and/or the second oxidant via line 152 can occur over a short period of time or can gradually transition from a full introduction rate to none.

The syngas via line 186 can be further processed according to any desired manner. For example, at least a portion of the syngas in line 186 can be directed to a gas or combustion turbine which can be coupled to a generator to produce electrical power. In another example, at least a portion of the syngas in line 186 can be separated to produce a hydrogen product. In another example, at least a portion of the syngas in line 186 can be directed to one or more gas converters to produce one or more Fischer-Tropsch products, methanol, ammonia, chemicals, hydroformylation products, and/or feedstocks, derivatives thereof, and/or combinations thereof.

The one or more Fischer-Tropsch products can include, but are not limited to, one or more hydrocarbons having a wide range of molecular weights, spanning from light gaseous hydrocarbons ($C_1$-$C_4$), naphtha ($C_5$-$C_{10}$), diesel ($C_{11}$-$C_{20}$), and wax (>$C_{20}$), derivatives thereof, or combinations thereof. Illustrative Fischer-Tropsch products can include, but are not limited to, diesel fuels, kerosene, aviation fuels, propane, butane, liquefied petroleum gas (LPG), lubricants, naphtha, gasoline, detergents, waxes, lubricants, refinery/petrochemical feedstocks, other transportation fuels, synthetic crude oil, liquid fuels, alpha olefins, or any combination thereof.

The methanol can be used as produced and/or further processed to provide one or more additional products. Additional products produced from methanol can include, but are not limited to, dimethyl ether (DME), formalin, acetic acid, formaldehyde, methyl-tertiary butyl ether, methylamines, methyl methacrylate, dimethyl terephthalate, methyl mercaptan, methyl chloride methyl acetate, acetic anhydride, ethylene, propylene, polyolefins, derivatives thereof, mixtures thereof, or combinations thereof.

The ammonia product can be used as produced and/or further processed to provide one or more additional products. Additional products that can be produced, at least in part, from ammonia can include, but are not limited to, urea, ammonium salts, ammonium phosphates, nitric acid, acrylonitrile, amides, and the like.

Illustrative systems and methods for further processing at least a portion of the syngas in line 186 can be as discussed and described in U.S. Pat. Nos. 7,932,296; 7,722,690; 7,687,041; and 7,138,001 and U.S. Patent Application Publication Nos.: 2009/0294328; 2009/0261017; 2009/0151250; and 2009/0064582.

Embodiments discussed and described herein further relate to any one or more of the following paragraphs:

1. A method for gasifying a hydrocarbon feedstock, comprising: gasifying a hydrocarbon feedstock in the presence of one or more particulates to produce a syngas and one or more carbon-containing particulates; combusting at least a portion of the carbon of the one or more carbon-containing particulates in a combustion process external to the gasifying of the hydrocarbon feedstock to produce a combustion gas; and utilizing the combustion gas in one or more processes external to the gasifying of the hydrocarbon feedstock.

2. The method of paragraph 1, wherein the one or more carbon-containing particulates comprise carbon-containing coarse ash, carbon-containing fine ash, or a combination thereof.

3. The method of paragraph 1 or 2, wherein the one or more processes external to the gasifying of the hydrocarbon feedstock comprise: heating a boiler feed water; heating at least a portion of the syngas; heating a first oxidant; heating a steam; or a combination thereof.

4. The method according to any one of paragraphs 1 to 3, wherein heating the boiler feed water produces a first steam, and wherein the method further comprises introducing the first steam to the gasifying of the hydrocarbon feedstock, exporting the first steam to a process external to the gasifying of the hydrocarbon feedstock, supplying the first steam to a steam turbine to produce electrical power, or a combination thereof.

5. The method according to any one of paragraphs 1 to 4, wherein heating at least a portion of the syngas produces a heated syngas, and wherein the method further comprises introducing the heated syngas to the gasifying of the hydrocarbon feedstock.

6. The method according to any one of paragraphs 1 to 5, wherein heating the first oxidant produces a heated first oxidant, and wherein the method further comprises introducing the heated first oxidant to the gasifying of the hydrocarbon feedstock.

7. The method according to any one of paragraphs 1 to 6, wherein heating the steam produces a second steam, and wherein the method further comprises introducing the second steam to the gasifying of the hydrocarbon feedstock, exporting the second steam to a process external to the gasifying of the hydrocarbon feedstock, supplying the second steam to a steam turbine to produce electrical power, or a combination thereof.

8. The method according to any one of paragraphs 1 to 7, wherein the one or more processes external to the gasifying of the hydrocarbon feedstock comprise drying a moisture-containing hydrocarbon feedstock to produce a dried hydrocarbon feedstock having a moisture concentration ranging from about 12 wt % to about 22 wt %, and wherein the hydrocarbon feedstock comprises the dried hydrocarbon feedstock.

9. The method according to any one of paragraphs 1 to 8, wherein the particulates comprise sand, ceramic materials, ash, crushed limestone, inorganic oxides, or a combination thereof.

10. The method according to any one of paragraphs 1 to 9, wherein an average particle size of the carbon-containing coarse ash ranges from about 50 μm to about 350 μm, and wherein an average particle size of the carbon-containing fine ash ranges from about 5 μm to about 30 μm.

11. The method according to any one of paragraphs 1 to 10, wherein the combustion process comprises a slagging combustor, an ash furnace, a pulverized-coal furnace, or a combination thereof.

12. The method according to any one of paragraphs 1 to 11, wherein the hydrocarbon feedstock comprises one or more bituminous coals, one or more sub-bituminous coals, one or more anthracite coals, one or more petroleum cokes, or a combination thereof.

13. The method according to any one of paragraphs 1 to 12, wherein an operating temperature of the gasifying ranges from about 700° C. to about 1,100° C.

14. A method for gasifying a hydrocarbon feedstock, comprising: gasifying a hydrocarbon feedstock in the presence of one or more particulates to produce a syngas and one or more carbon-containing particulates; combusting at least a portion of the carbon of the one or more carbon-containing particulates in a combustion process external to the gasifying of the hydrocarbon feedstock to produce a combustion gas; and utilizing the combustion gas in one or more processes external to the gasifying of the hydrocarbon feedstock, wherein the one or more carbon-containing particulates comprise carbon-containing coarse ash, carbon-containing fine ash, or a combination thereof, and wherein the one or more processes external to the gasifying of the hydrocarbon feedstock comprise: heating a boiler feed water; heating at least a portion of the syngas; heating a first oxidant; heating a steam; drying a moisture-containing hydrocarbon feedstock; or a combination thereof.

15. The method of paragraph 14, wherein heating the boiler feed water produces a first steam, heating at least a portion of the syngas produces a heated syngas, heating the first oxidant produces a heated first oxidant, heating the steam produces a second steam, and drying the moisture-containing hydrocarbon feedstock produces a dried hydrocarbon feedstock having a moisture concentration ranging from about 12 wt % to about 22 wt %, the method further comprising: introducing the first steam to the gasifying of the hydrocarbon feedstock, exporting the first steam to a process external to the gasifying of the hydrocarbon feedstock, supplying the first steam to a steam turbine to produce electrical power, or a combination thereof; introducing the heated syngas to the gasifying of the hydrocarbon feedstock; introducing the heated first oxidant to the gasifying of the hydrocarbon feedstock; introducing the second steam to the gasifying of the hydrocarbon feedstock, exporting the second steam to a process external to the gasifying of the hydrocarbon feedstock, supplying the second steam to a steam turbine to produce electrical power, or a combination thereof; and introducing the dried hydrocarbon feedstock to the gasifying of the hydrocarbon feedstock.

16. The method of paragraph 14 or 15, wherein the particulates comprise sand, ceramic materials, ash, crushed limestone, inorganic oxides, or a combination thereof.

17. The method according to any one of paragraphs 14 to 16, wherein an average particle size of the carbon-containing coarse ash ranges from about 50 μm to about 350 μm, and wherein an average particle size of the carbon-containing fine ash ranges from about 5 μm to about 30 μm.

18. The method according to any one of paragraphs 14 to 17, wherein the at least a portion of the carbon of the one or more carbon-containing particulates is combusted in a combustor, wherein the combustor comprises a slagging combustor, an ash furnace, a pulverized-coal furnace, or a combination thereof.

19. The method according to any one of paragraphs 14 to 18, wherein the hydrocarbon feedstock comprises one or more bituminous coals, one or more sub-bituminous coals, one or more anthracite coals, one or more petroleum cokes, or a combination thereof.

20. An apparatus for gasifying a hydrocarbon feedstock, comprising: a gasifier; a combustor, wherein the combustor is external relative to the gasifier; a carbon-containing particulate line in fluid communication with the gasifier and the combustor; and one or more lines in fluid communication with the combustor and one or more processes external to the gasifier.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for gasifying a hydrocarbon feedstock, comprising:

gasifying a hydrocarbon feedstock in a gasifier in the presence of one or more particulates to produce a syngas and carbon-containing particulates;

recycling the produced syngas using processes external to the gasifying of the hydrocarbon feedstock, wherein the processes external to the gasifying of the hydrocarbon feedstock sequentially comprise:

cooling the syngas by at least a first heat exchanger, performing particulate control on the cooled syngas, further cooling the cooled syngas after the particulate control by at least a second heat exchanger, heating the twice cooled syngas in a combustor external to the gasifier, and introducing the heated syngas to the gasifier;

cooling the carbon-containing particulates;

combusting at least a portion of the carbon of the cooled carbon-containing particulates in a combustion process by the combustor external to the gasifying of the hydrocarbon feedstock to produce a combustion gas; and utilizing the combustion gas in further processes external to the gasifying of the hydrocarbon feedstock, wherein the further processes external to the gasifying of the hydrocarbon comprise drying a moisture-containing hydrocarbon feedstock to produce a dried hydrocarbon feedstock, and wherein the hydrocarbon feedstock comprises the dried hydrocarbon feedstock.

2. The method of claim 1, wherein the carbon-containing particulates comprise carbon-containing coarse ash, carbon-containing fine ash, or a combination thereof.

3. The method of claim 1, wherein the processes external to the gasifying of the hydrocarbon feedstock further comprise: heating a boiler feed water; heating at least a portion of the syngas; heating a first oxidant; heating a steam; or a combination thereof.

4. The method of claim 3, wherein heating the boiler feed water produces a first steam, and wherein the method further comprises introducing the first steam to the gasifying of the hydrocarbon feedstock, exporting the first steam to a process external to the gasifying of the hydrocarbon feedstock, supplying the first steam to a steam turbine to produce electrical power, or a combination thereof.

5. The method of claim 3, wherein heating the first oxidant produces a heated first oxidant, and wherein the method further comprises introducing the heated first oxidant to the gasifying of the hydrocarbon feedstock.

6. The method of claim 3, wherein heating the steam produces a second steam, and wherein the method further comprises introducing the second steam to the gasifying of the hydrocarbon feedstock, exporting the second steam to a process external to the gasifying of the hydrocarbon feedstock, supplying the second steam to a steam turbine to produce electrical power, or a combination thereof.

7. The method of claim 1, wherein the dried hydrocarbon feedstock has a moisture concentration ranging from about 12 wt % to about 22 wt %.

8. The method of claim 1, wherein the particulates comprise sand, ceramic materials, ash, crushed limestone, inorganic oxides, or a combination thereof.

9. The method of claim 1, wherein the combustor comprises one of: a slagging combustor, an ash furnace, and a pulverized-coal furnace; and the combustion process further comprising:

maintaining a molar ratio of oxygen in a sub-stoichiometric proportion during the gasifying process; and maintaining a stoichiometric excess of combustion oxidant during the combustion process.

10. The method of claim 1, wherein the hydrocarbon feedstock comprises one or more bituminous coals, one or more sub-bituminous coals, one or more anthracite coals, one or more petroleum cokes, or a combination thereof.

11. The method of claim 1, wherein the gasifier is selected from one of: (i) a circulating solids gasifier, and (ii) an entrained flow gasifier.

12. The method of claim 1, further comprising conveying the syngas from the gasifier using a first line;

conveying at least a portion of the one or more carbon-containing particulates from the gasifier using a second line separate from the first line; and conveying the at least a portion of the carbon-containing particulates using the second line to the hydrocarbon stock being gasified.

13. The method of claim 12, further comprising separating the syngas from the carbon-containing particulates, wherein the separated carbon containing particulates is conveyed by the second line.

14. The method of claim 12, wherein the coarse ash is conveyed via the second line, and the fine ash is conveyed to the hydrocarbon stock being gasified using a third line separate from the second line.

15. A method for gasifying a hydrocarbon feedstock, comprising:

gasifying a hydrocarbon feedstock in a gasifier in the presence of one or more particulates to produce a syngas and carbon-containing particulates;

recycling the produced syngas using processes external to the gasifying of the hydrocarbon feedstock, wherein the processes external to the gasifying of the hydrocarbon feedstock sequentially comprise:

cooling the syngas by at least a first heat exchanger;

performing particulate control on the cooled syngas;

further cooling the cooled syngas after the particulate control by at least a second heat exchanger;

heating the twice cooled syngas in a combustor external to the gasifier; and introducing the heated syngas to the gasifier;

combusting at least a portion of the carbon of the carbon-containing particulates in a combustion process by the combustor external to the gasifying of the hydrocarbon feedstock to produce a combustion gas; and utilizing the combustion gas in further processes external to the gasifying of the hydrocarbon feedstock, wherein the further processes external to the gasifying of the hydrocarbon feedstock comprise drying a moisture-containing hydrocarbon feedstock to produce a dried hydrocarbon feedstock, wherein the hydrocarbon feedstock comprises the dried hydrocarbon feedstock, wherein the one or more carbon-containing particulates comprise carbon-containing coarse ash, carbon-containing fine ash, or a combination thereof, and wherein the one or more processes external to the gasifying of the hydrocarbon feedstock comprise: heating a boiler feed water; heating a first oxidant; heating a steam; or a combination thereof.

16. The method of claim 15, wherein heating the boiler feed water produces a first steam, heating at least a portion of the syngas produces a heated syngas, heating the first oxidant produces a heated first oxidant, heating the steam produces a second steam, and drying the moisture-containing hydrocarbon feedstock produces a dried hydrocarbon feedstock having a moisture concentration ranging from about 12 wt % to about 22 wt %, the method further comprising:

introducing the first steam to the gasifying of the hydrocarbon feedstock, exporting the first steam to a process external to the gasifying of the hydrocarbon feedstock, supplying the first steam to a steam turbine to produce electrical power, or a combination thereof;

introducing the heated syngas to the gasifying of the hydrocarbon feedstock;

introducing the heated first oxidant to the gasifying of the hydrocarbon feedstock;

introducing the second steam to the gasifying of the hydrocarbon feedstock, exporting the second steam to a process external to the gasifying of the hydrocarbon feedstock, supplying the second steam to a steam turbine to produce electrical power, or a combination thereof; and introducing the dried hydrocarbon feedstock to the gasifying of the hydrocarbon feedstock.

17. The method of claim 15, wherein the at least a portion of the carbon of the carbon-containing particulates is combusted in the combustor, wherein the combustor comprises one of: a slagging combustor, an ash furnace, and a pulverized-coal furnace.

18. The method of claim 15, further comprising:

cooling the carbon-containing particulates before combusting the at least a portion of the carbon of the carbon-containing particulates; and using a supplemental fuel in addition to the at least a portion of the carbon of the carbon-containing particulates during the combustion.

* * * * *